US007432788B2

(12) United States Patent
Glukh et al.

(10) Patent No.: US 7,432,788 B2
(45) Date of Patent: Oct. 7, 2008

(54) MICROELECTROMECHANICAL MAGNETIC SWITCHES HAVING ROTORS THAT ROTATE INTO A RECESS IN A SUBSTRATE

(75) Inventors: Konstantin Glukh, Apex, NC (US); Robert L. Wood, Apex, NC (US); Vivek Agrawal, Durham, NC (US)

(73) Assignee: MEMSCAP, Inc., Durham, NC (US)

( * ) Notice: Subject to any disclaimer, the term of this patent is extended or adjusted under 35 U.S.C. 154(b) by 0 days.

(21) Appl. No.: 10/859,633

(22) Filed: Jun. 3, 2004

(65) Prior Publication Data

US 2004/0263297 A1 Dec. 30, 2004

Related U.S. Application Data

(60) Provisional application No. 60/483,291, filed on Jun. 27, 2003.

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 4,570,139 | A * | 2/1986 | Kroll | 335/187 |
| 5,629,918 | A | 5/1997 | Ho et al. | |
| 5,666,258 | A * | 9/1997 | Gevatter et al. | 361/207 |
| 6,320,145 | B1 | 11/2001 | Tai et al. | |
| 6,396,975 | B1 | 5/2002 | Wood et al. | |
| 6,407,478 | B1 | 6/2002 | Wood et al. | |
| 6,580,947 | B1 | 6/2003 | Thompson | |
| 6,747,390 | B2 * | 6/2004 | Park et al. | 310/309 |
| 2002/0140533 | A1 | 10/2002 | Miyazaki et al. | |
| 2002/0171909 | A1 | 11/2002 | Wood et al. | |
| 2003/0071283 | A1 | 4/2003 | Heschel | |
| 2004/0246558 | A1 * | 12/2004 | Yoon et al. | 359/291 |

FOREIGN PATENT DOCUMENTS

| | | | |
|---|---|---|---|
| EP | 0 573 267 | A1 | 12/1993 |
| EP | 0 685 864 | A1 | 12/1995 |
| WO | WO 00/44020 | A2 | 7/2000 |

OTHER PUBLICATIONS

Tai et al., *Micromachined Magnetostatic Switches*, Jet Propulsion Laboratory, California Institute of Technology, Oct. 1998, pp. i, 1-7, 1b-3b.

* cited by examiner

*Primary Examiner*—Elvin Enad
*Assistant Examiner*—Bernard Rojas
(74) *Attorney, Agent, or Firm*—Burr & Brown

(57) ABSTRACT

A magnetic switch includes a substrate having a recess therein. A rotor or rotors are provided on the substrate. The rotor includes a tail portion that overlies the recess, and a head portion that extends on the substrate outside the recess. The rotor may be fabricated from ferromagnetic material, and is configured to rotate the tail in the recess in response to a changed magnetic field. First and second magnetic switch contacts also are provided that are configured to make or break electrical connection between one another in response to rotation of the tail in the recess, in response to the changed magnetic field. Related operation and fabrication methods also are described.

40 Claims, 14 Drawing Sheets

MICROELECTROMECHANICAL MAGNETIC SWITCHES HAVING ROTORS THAT ROTATE INTO A RECESS IN A SUBSTRATE

CROSS-REFERENCE TO RELATED APPLICATION

This application claims the benefit of Provisional Application No. 60/483,291, filed Jun. 27, 2003, entitled Microelectromechanical Proximity Switches, Packages and Fabrication Methods, assigned to the assignee of the present application, the disclosure of which is hereby incorporated herein by reference in its entirety as if set forth fully herein.

FIELD OF THE INVENTION

This invention relates to magnetic switches and fabrication methods therefor, and more particularly to microelectromechanical system (MEMS) magnetic switches and fabrication methods therefor.

BACKGROUND OF THE INVENTION

Magnetic switches are used to make or break electrical connections using a local permanent and/or electromagnetic field. A "normally open" type of magnetic switch closes when brought into close proximity to a suitably oriented magnetic field, while a "normally closed" type opens when subjected to a magnetic field. Such switches may be used in a variety of industrial, medical, and security applications, and may be particularly advantageous in situations where opening or closing of a circuit may be accomplished without physical contact with the switch. For example, in-vivo medical devices may be sealed to provide biocompatibility and to protect the device. Such devices may not have an external "on-off" switch to activate the device. A magnetic switch sealed within the device and controlled by an external magnet can provide a switch to activate the device.

Many commercially available magnetic switches are based on "reed switches" constructed of thin elastic reeds made of a ferromagnetic material. These reeds may be tipped with noble metal films to provide low contact resistance and sealed into a glass and/or other tube. When a permanent magnet or electromagnet is brought into close proximity with the tube, the reeds either move toward or away from one another, making or breaking the contact. When the magnet is removed, the reeds return elastically to their original position, resetting the switch. One potential disadvantage of conventional reed-based magnetic switches is that they may be relatively large, for example about one inch in length and about ⅛" to ¼" in diameter. For applications where small size is desired, such as in-vivo medical devices, conventional reed magnetic switches may be too large. Moreover, reed switches may be undesirably fragile.

MEMS devices have been recently developed as alternatives for conventional electromechanical devices, in-part because MEMS devices are potentially low cost, due to the use of simplified microelectronic fabrication techniques. New functionality may also be provided because MEMS devices can be much smaller than conventional electromechanical systems and devices. MEMS devices are described, for example, in U.S. patent application Publication No. 2002/0171909 A1 to Wood et al., entitled MEMS Reflectors Having Tail Portions That Extend Inside a Recess and Head Portions That Extend Outside the Recess and Methods of Forming Same, and U.S. Pat. No. 6,396,975 to Wood et al., entitled MEMS Optical Cross-Connect Switch.

MEMS devices and manufacturing methods have been used to provide magnetic switches. For example, Integrated Micromachines Inc. (IMMI) developed a reed-like magnetic switch using MEMS technology. See FIG. 1. It is a normally open switch with approximate dimensions 2.5×2×1 mm and contact resistance in closed state of about 50 Ω. Unfortunately, the reed configuration may inherently lead to poor shock/vibration resistance and/or high contact resistance. It also may be difficult to build a normally closed switch based on this technology. The switch also may only be configured as Single Pole Single Throw (SPST), but it may be difficult to provide Double Pole Single Throw (DPST) or Single Pole Double Throw (SPDT) versions. Reed switches also generally do not have a wiping action, i.e., they generally are not self-cleaning and contact resistance may go up with time.

Published U.S. patent application Publication No. 2002/0140533 A1 to Miyazaki et al., entitled Method of Producing An Integrated Type Microswitch, also describes a MEMS-based microswitch. As described in the Abstract of this patent application publication, an integrated type microswitch with high durability is provided. The integrated type microswitch is of the construction through micro-machining process in which a movable plate is provided above a fulcrum means movable in seesaw movement by means of either electrostatic or magnetic force, so that either one of movable contacts mounted on opposite free ends thereof is on-off connected to fixed contact disposed in opposite relation due to seesaw movement of the movable plate. See the Abstract of this publication.

U.S. Pat. No. 6,320,145 to Tai et al., entitled Fabricating and Using a Micromachined Magnetostatic Relay or Switch, also describes a MEMS-based microswitch. As described in the Abstract of this patent, a micromachined magnetostatic relay or switch includes a springing beam on which a magnetic actuation plate is formed. The springing beam also includes an electrically conductive contact. In the presence of a magnetic field, the magnetic material causes the springing beam to bend, moving the electrically conductive contact either toward or away from another contact, and thus creating either an electrical short-circuit or an electrical open-circuit. The switch is fabricated from silicon substrates and is particularly useful in forming a MEMs commutation and control circuit for a miniaturized DC motor. See the Abstract of this patent. A similar configuration is described in a publication entitled *Micromachined Magnetostatic Switches,* to Tai et al., Jet Propulsion Laboratory, California Institute of Technology, October 1998, pp. i, 1-7, 1b-3b.

A MEMS micromagnetic actuator is also described in U.S. Pat. No. 5,629,918 to Ho et al., entitled Electromagnetically Actuated Micromachined Flap. As noted in the Abstract of this patent, a surface micromachined micromagnetic actuator is provided with a flap capable of achieving large deflections above 100 microns using magnetic force as the actuating force. The flap is coupled by one or more beams to a substrate and is cantilevered over the substrate. A Permalloy layer or a magnetic coil is disposed on the flap such that when the flap is placed in a magnetic field, it can be caused to selectively interact and rotate out of the plane of the magnetic actuator. The cantilevered flap is released from the underlying substrate by etching out an underlying sacrificial layer disposed between the flap and the substrate. The etched out and now cantilevered flap is magnetically actuated to maintain it out of contact with the substrate while the just etched device is dried in order to obtain high release yields. See the Abstract of this patent.

Finally, an implantable medical device that includes a MEMS magnetic switch is described in U.S. Pat. No. 6,580, 947 to Thompson, entitled Magnetic Field Sensor for an Implantable Medical Device. As described in the Abstract of this patent, an implantable medical device (IMD) uses a solid-state sensor for detecting the application of an external magnetic field, the sensor comprises one or more magnetic field responsive microelectromechanical (MEM) switch fabricated in an IC coupled to a switch signal processing circuit of the IC that periodically determines the state of each MEM. The MEM switch comprises a moveable contact suspended over a fixed contact by a suspension member such that the MEM switch contacts are either normally open or normally closed. A ferromagnetic layer is formed on the suspension member, and the suspended contact is attracted or repelled toward or away from the fixed contact. The ferromagnetic layer, the characteristics of the suspension member, and the spacing of the switch contacts may be tailored to make the switch contacts close (or open) in response to a threshold magnetic field strength and/or polarity. A plurality of such magnetically actuated MEM switches are provided to cause the IMD to change operating mode or a parameter value and to enable or effect programming and uplink telemetry functions. See the Abstract of this patent.

SUMMARY OF THE INVENTION

Magnetic switches according to some embodiments of the present invention comprise a substrate including therein a recess. A rotor is provided on the substrate. The rotor includes a tail portion that overlies the recess, and a head portion that extends on the substrate outside the recess. The rotor comprises ferromagnetic material, and is configured to rotate the tail in the recess, in response to a changed magnetic field, including application of a magnetic field and/or removal of a magnetic field. First and second magnetic switch contacts also are provided that are configured to make or break electrical connection between one another in response to rotation of the tail in the recess, in response to the changed magnetic field. Analogous methods of operating a magnetic switch are also provided.

In some embodiments, a hinge is coupled to the rotor, to define an axis about which the tail is configured to rotate in the recess in response to the changed magnetic field. In some embodiments, the recess includes a wall that intersects with the substrate at the axis. In some embodiments, the hinge is a torsional hinge that is configured to allow the rotor to rotate about the axis. Other conventional MEMS hinges also may be provided.

Many configurations of the first and second magnetic switch contacts may be provided according to various embodiments of the present invention. For example, in some embodiments, the first contact is on the head portion and the second contact is on the substrate adjacent the head portion. In other embodiments, the first contact is on the tail portion and the second contact is in the recess adjacent the tail portion. In still other embodiments, a cap is provided on the substrate that is spaced apart from the rotor, to allow rotation thereof. In some of these embodiments, the first contact is on the head portion, and the second contact is on the cap adjacent the head portion. In other embodiments, the first contact is on the tail portion, and the second contact is on the cap adjacent the tail portion. Combinations and subcombinations of these embodiments may be provided.

In still other embodiments of the present invention, the first contact and the second contact are on the substrate adjacent the head portion. In other embodiments, the first contact and the second contact are in the recess adjacent the tail portion. In still other embodiments, a cap is provided as described above, and the first contact and the second contact are on the cap adjacent the head portion. In still other embodiments, the first contact and the second contact are on the cap adjacent the tail portion. Combinations and subcombinations of these and/or the previously described embodiments may be provided.

In embodiments of the present invention where the first and second contacts are on the rotor (head portion or tail portion) and the substrate, first and second vias maybe provided that extend through the substrate. First and second conductors also may be provided that extend through the respective first and second vias. A respective one of the first and second conductors is electrically connected to a respective one of the first and second contacts, to provide external contacts for the magnetic switch on the substrate. In other embodiments, where one contact is provided on the substrate (including on the head or tail portion of the rotor), and a second contact is provided on the cap, a via and a first conductor that extends through the via may be provided to provide an external contact for the magnetic switch on the substrate. Moreover, a second conductor may be provided on the cap that is electrically connected to the second contact, to provide an external contact for the magnetic switch on the cap. In yet other embodiments, when the first and second contacts are provided on the cap, first and second electrical conductors also may be provided on the cap, a respective one of which is electrically connected to a respective one of the first and second contacts, to provide external contacts for the magnetic switch on the cap. Accordingly, external contacts for the magnetic switch may be provided on the substrate and/or on the cap.

In still other embodiments of the present invention, the first and/or second contacts are on the substrate outside the head portion, and are configured to move beneath the head portion. In some embodiments, the first and/or second contacts are configured to inelastically deform, to move beneath the head portion and remain beneath the head portion. In some embodiments, first and second beams are provided having fixed ends, and movable ends that are connected to the first (or second) contact. The first and/or second beams are configured to move, and in some embodiment to inelastically deform, upon application of heat thereto, to move the first (or second) contact beneath the head portion. In still other embodiments, a beam having a fixed end and a movable end that is connected to the first (or second) contact is provided. The beam is configured to move, and in some embodiments to inelastically deform, upon application of heat thereto, to move the first (or second) contact beneath the head portion. In still other embodiments, an actuator is provided on the substrate that is configured to move the first and/or second contacts beneath the head portion.

In still other embodiments of the present invention, the rotor is configured to rotate the tail in the recess and also to wipe the first and/or second contact in response to the changed magnetic field. A contact cleaning or wiping action thereby may be provided.

In other embodiments, a permanent magnet also is provided that generates a constant magnetic field, to maintain the rotor in a predetermined position. In these embodiments, the rotor is configured to rotate from the predetermined position in response to the changed magnetic field. Moreover, other embodiments can provide a latch, such as a snapping tether, that is coupled to the rotor. The latch is configured to maintain the rotor such that the first and second contacts continue to make or break electrical connection between one another. A bistable switch thereby may be provided.

In yet other embodiments of the present invention, a housing is provided and a permanent magnet is coupled to the housing. The magnetic switch is removably coupled to the housing, and configured such that removal of the magnetic switch from the housing causes the first and second magnetic switch contacts to make or break electrical connection between one another. In still other embodiments, an electrical device is electrically connected to the first and/or second contacts, and is configured to become operative upon the first and second magnetic switch contacts making or breaking electrical connection between one another. In still other embodiments, an encapsulating structure is provided wherein the magnetic switch and the electrical device are encapsulated by the encapsulating structure.

Magnetic switches may be fabricated according to some embodiments of the present invention, by forming on a substrate a rotor comprising ferromagnetic material and including a tail portion and a head portion at opposite ends thereof, and a contact that is outside the rotor. A recess is formed in the substrate beneath the tail portion. The contact that is outside the rotor is moved to beneath the rotor. In some embodiments, prior to moving the contact, the tail is rotated into the recess to provide a gap between the head portion and the substrate. The contact is then moved along the substrate into the gap between the head portion and the substrate. In other embodiments, the recess may be formed prior to forming the rotor, such that the tail portion is formed above the recess.

In some embodiments, the contact is moved by using an external probe. In other embodiments, a beam is provided on the substrate having a free end that is connected to the contact and a fixed end remote from the free end, and the contact is moved by deforming the free end of the beam. The beam may be deformed inelastically using a probe, using heat and/or using an actuator that is also provided on the substrate.

Other method embodiments of the present invention place a cap on the substrate that is spaced apart from the rotor, to allow rotation thereof. Still other embodiments form a via that extends through the substrate and form a conductor that extends through the via and is electrically connected to the contact, to provide an external contact for the magnetic switch on the substrate. Still other embodiments electrically connect an electrical device to the contact, and encapsulate the electrical device and the substrate. In still other embodiments, the substrate and the electrical device that are encapsulated are removably placed into a housing that includes a permanent magnet therein, to cause the contact to electrically connect to or electrically disconnect from the rotor. In still other embodiments, the substrate and the electrical device that are encapsulated are removed from the housing, to cause the contact to electrically disconnect from or electrically connect to the rotor.

DETAILED DESCRIPTION

Figure 1:
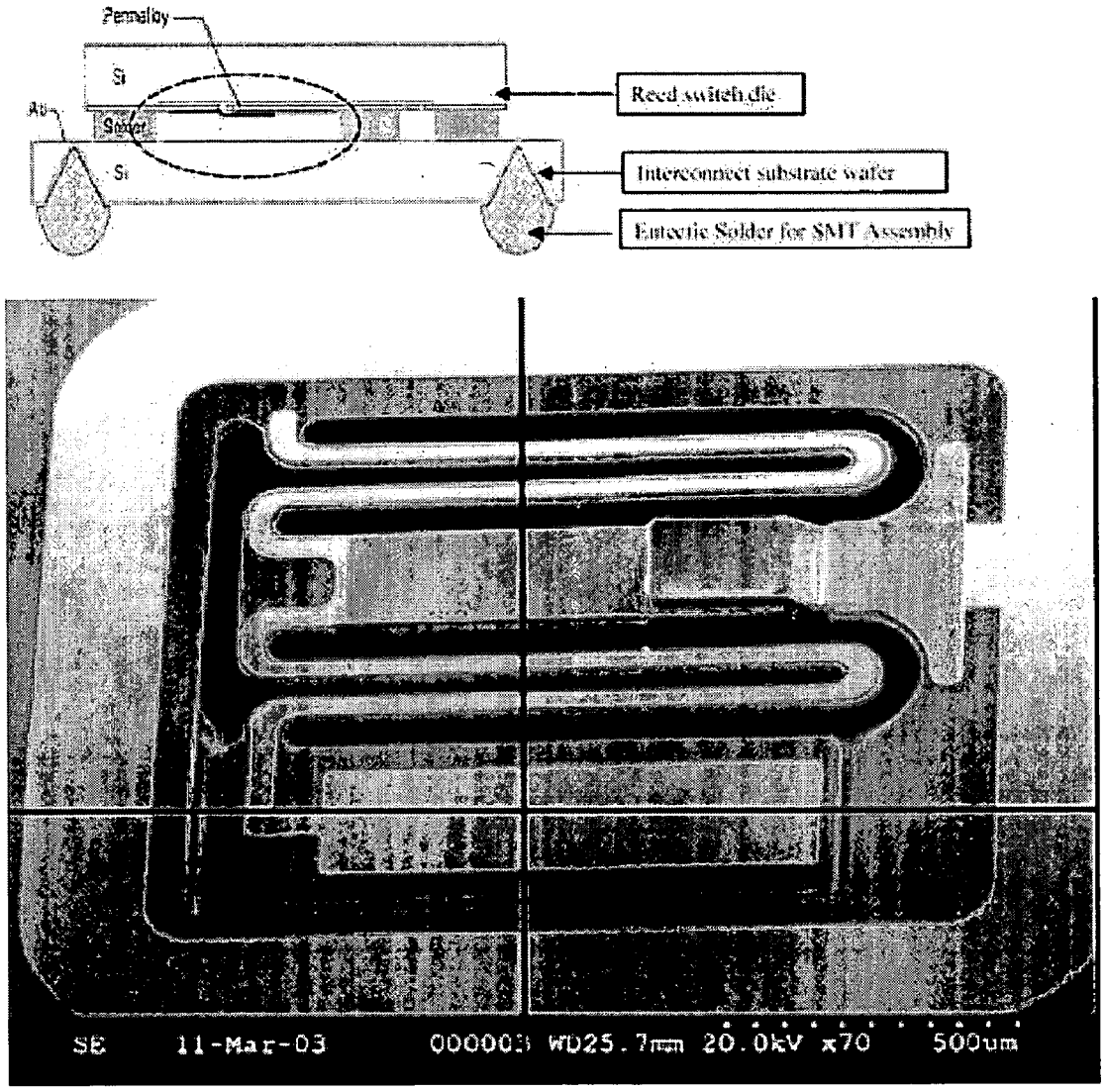
FIG. 1 (PRIOR ART)
FIG. 1 illustrates a conventional reed-like magnetic switch using MEMS technology.

The present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity. Moreover, each embodiment described and illustrated herein includes its complementary conductivity type embodiment as well. Like numbers refer to like elements throughout.

It will be understood that when an element such as a layer, region or substrate is referred to as being "on" another element, it can be directly on the other element or intervening elements may also be present. It will be understood that when an element is referred to as being "connected" or "coupled" to another element, it can be directly connected or coupled to the other element or intervening elements may be present. In contrast, when an element is referred to as being "directly on", "directly connected" or "directly coupled" to another element, there are no intervening elements present. It will also be understood that although the terms first and second are used herein to describe various elements, these elements should not be limited by these terms. These terms are only used to distinguish one element from another element. Thus, a first element could be termed a second element, and similarly, a second element may be termed a first element without departing from the teachings of the present invention. As used herein, the term "and/or" includes any and all combinations of one or more of the associated listed items. It will be understood that if part of an element, such as a surface of a conductive line, is referred to as "outer," it is closer to the outside of the device than other parts of the element. Furthermore, relative terms such as "beneath" or "above" may be used herein to describe a relationship of one layer or region to another layer or region relative to a substrate or base layer as illustrated in the figures. It will be understood that these terms are intended to encompass different orientations of the device in addition to the orientation depicted in the figures.

Figure 2:
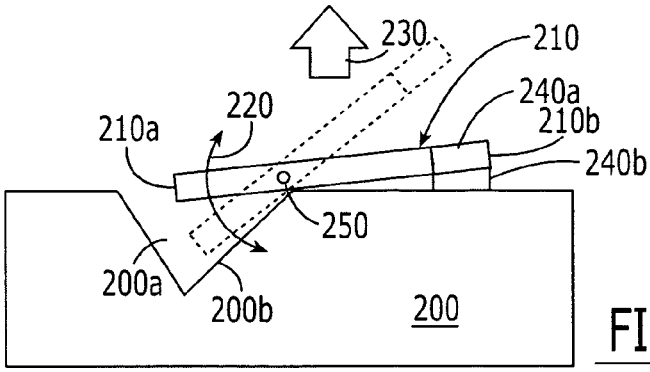
FIGS. 2-5 are cross-sectional views of magnetic switches according to various embodiments of the present invention.

FIG. 2 is a cross-sectional view of a magnetic switch according to various embodiments of the present invention. As shown in FIG. 2, these embodiments of magnetic switches include a substrate 200, having a recess 200*a* therein. The substrate may comprise a conventional microelectronic substrate, such as a silicon, compound semiconductor, semiconductor-on-insulator or other non-semiconductor substrate that is used to fabricate MEMS devices. In FIG. 2, the recess 200*a* is shown as being triangular is cross-section. However, other circular, elliptical, ellipsoidal and/or polygonal cross-section shapes may be used. Moreover, in FIG. 2, the recess 200*a* does not include a separate floor. However, in other embodiments, a floor may be provided.

Still referring to FIG. 2, a rotor 210 also is provided. Although the rotor 210 is shown as being straight, a curved and/or segmented rotor may be provided. The rotor includes a tail portion 210*a* that overlies the recess 200*a*, and a head portion 210*b* that extends on the substrate 200 outside the recess. The rotor 210 comprises ferromagnetic material, also referred to as a ferromagnetic rotor. In particular, the rotor may be fabricated entirely of ferromagnetic material, or only a portion thereof may comprise ferromagnetic material. The rotor 210 is configured to rotate the tail 210*a* in the recess 200*a* in the directions shown by arrows 220 in response to a changed magnetic field, shown schematically at 230. It will be understood that the changed magnetic field may comprise a change in the strength and/or direction of a magnetic field, the application of a magnetic field and/or the withdrawal of the magnetic field. The magnetic field 230 may be generated by a permanent magnetic and/or an electromagnet.

Still referring to FIG. 2, first and second magnetic switch contacts 240*a* and 240*b* also are provided. These magnetic switch contacts may be referred to simply as "contacts", and are configured to make or break electrical connection between one another in response to rotation of the tail 210*a* in the recess 200*a*, in response to the changed magnetic field 230. It will be understood by those having skill in the art that a contact may be a separate element, as shown by contact 240*b*, or may be a portion of a larger element, as shown by contact 240*a*, which comprises a portion of the head 210*b* of the rotor 210. Thus, the term "contact" as used herein encompasses a separate contact region or a portion of a larger region that functions as a contact.

Still referring to FIG. 2, a hinge (not shown in FIG. 2) is coupled to the rotor 210, to define an axis 250 about which the tail 210*a* is configured to rotate in the recess 200*a* in response to the changed magnetic field 230. The hinge can comprise a torsional hinge and/or other conventional MEMS hinge that allows rotation about an axis. In some embodiments, as shown in FIG. 2, the recess 210*a* includes a wall 200*b* that intersects with the substrate 200, at the axis 250.

Figure 3:
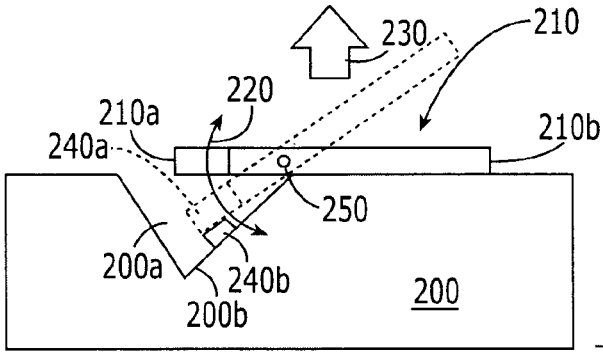

In embodiments of FIG. 2, the first contact 240*a* is on the head portion 210*b*, and the second contact 240*b* is on the substrate 200 adjacent the head portion 210*b*. FIG. 3 is a cross-sectional view of other embodiments, wherein the first contact 240*a* is on the tail portion 210*a*, and the second contact 240*b* is in the recess 200*a* adjacent the tail portion. Specifically, as shown in FIG. 3, the second contact 240*b*is on the wall 200*b*.

Figure 4:
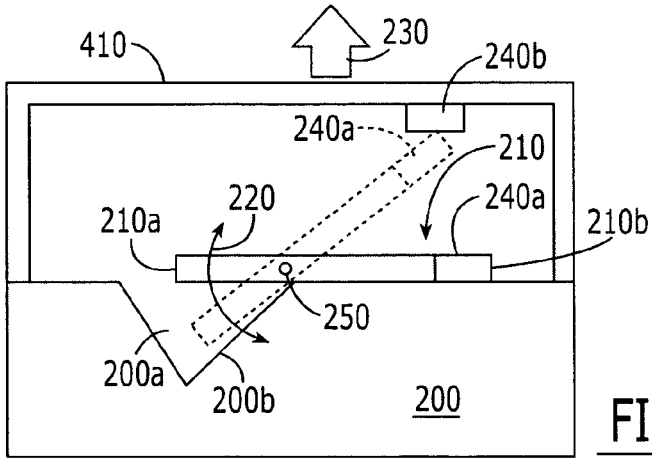

FIG. 4 is a cross-sectional view of other embodiments of the present invention. In FIG. 4, a cap 410 also is provided on the substrate 200, and is spaced apart from the rotor 210, to allow rotation thereof. In embodiments of FIG. 4, the first contact 240*a* is on the head portion 210*b*, and the second contact 240*b* is on the cap 410 adjacent the head portion 210*b*. It will be understood by those having skill in the art that the cap 410 may be a single piece cap or multi-piece cap and may have various configurations. The cap may act to hermetically seal the device or may be a non-hermetic cap.

Figure 5:
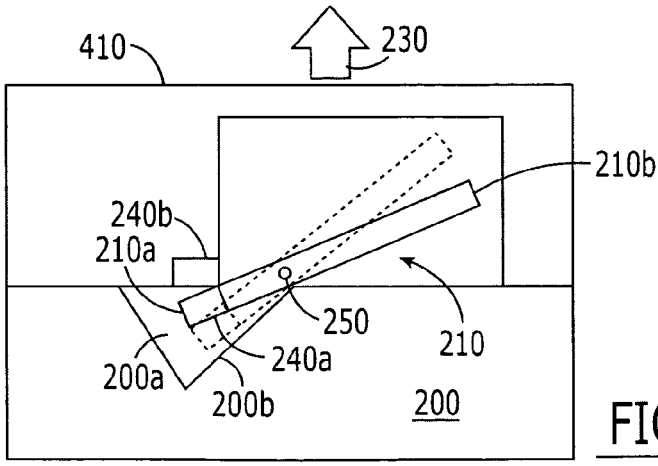

FIG. 5 illustrates other embodiments of the invention, wherein the first contact 240*a* is on the tail portion 210*a*, and the second contact is on the cap 410 adjacent the tail portion.

It also will be understood by those having skill in the art that the various contact configurations of FIGS. 2-5 may be combined in various combinations and subcombinations. Moreover, depending upon the action of the hinge and the orientation magnetic field 230, normally open and/or normally closed magnetic switches may be provided in any of the embodiments of FIGS. 2-5. Moreover, in any of the embodiments of FIGS. 2-5, external connections for the magnetic switches may be provided for the first contact by an electrical connection through the hinge and/or using other conventional electrical connections, and may be provided for the second contact 240*b* using conductors that are placed on the substrate 200 and/or on the cap 410, as will be described in detail below.

FIGS. 6-9 are top plan views of magnetic switches according to other embodiments of the present invention. In embodiments of FIGS. 2-5, the first contact 240*a* was attached to the rotor 210 and was, therefore, movable, whereas the second contact 240*b* was attached to the substrate 200 or cap 410, and was fixed. In contrast, in embodiments of FIGS. 6-9, both of the contacts are fixed, and movement of the rotor electrically connects the contacts to one another or electrically disconnects the contacts from one another.

Figure 6:
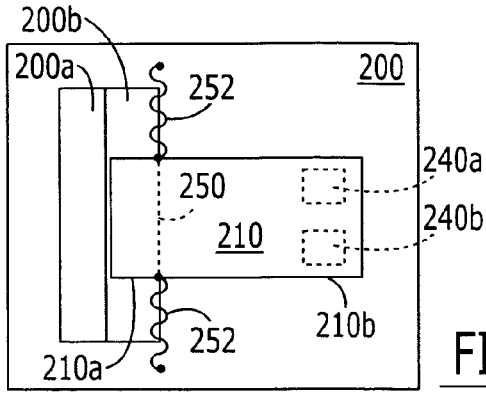
FIGS. 6-9 are top plan views of magnetic switches according to various embodiments of the present invention.
Figure 7:
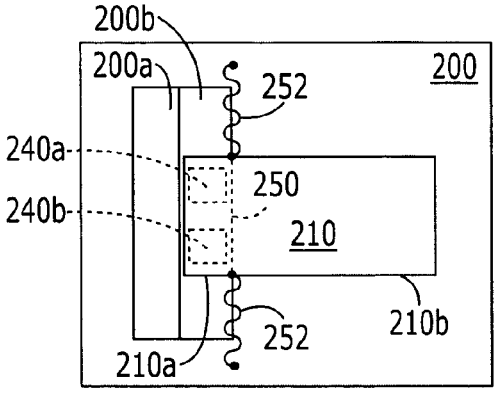
Figure 8:
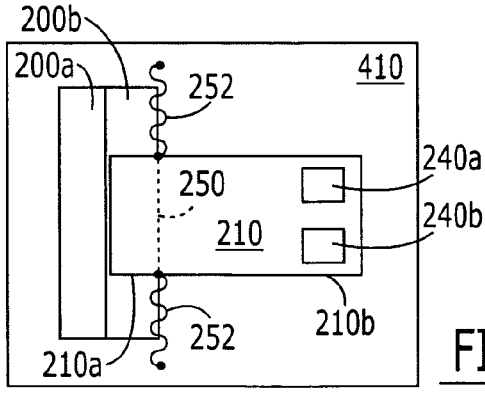
Figure 9:
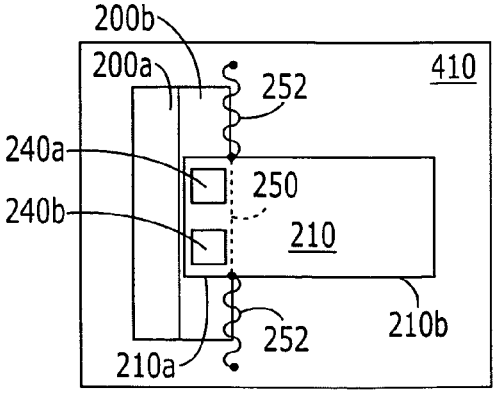

More specifically, in FIG. 6, the first contact 240*a* and the second contact 240*b* are on the substrate 200 adjacent the head portion 210*b*. A hinge 252 also is illustrated. In FIG. 7, the first contact 240*a* and the second contact 240*b* are in the recess 200*a* adjacent the tail portion 210*a*, and, specifically, are on the recess wall 200*b*. In FIG. 8, the first and second contacts 240*a*, 240*b* are on the cap 410 adjacent the head portion 210*b*. In FIG. 9, the first and second contacts 240*a*, 240*b* also are on the cap 410 adjacent the tail portion 210*a*. It will be understood by those having skill in the art that combinations and subcombinations of embodiments of FIGS. 6-9 may be provided, along with combinations and subcombinations of these embodiments with embodiments of FIGS. 2-5, according to various embodiments of the present invention.

Figure 10:
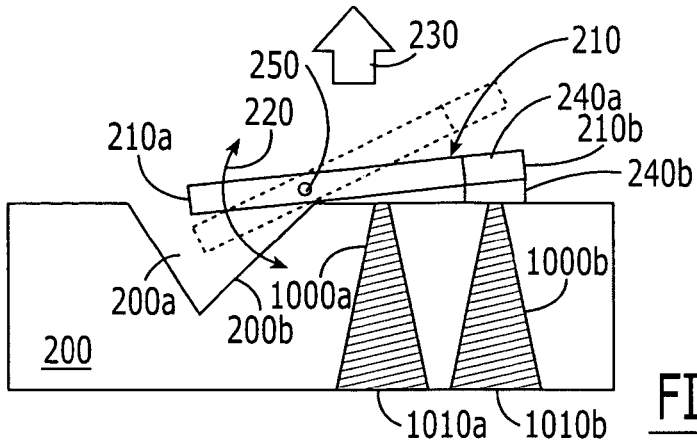
FIGS. 10-11 are cross-sectional views of magnetic switches according to various embodiments of the present invention.

FIG. 10 illustrates other embodiments of the present invention wherein external contacts are provided for the magnetic switch on the substrate. More specifically, embodiments of FIG. 10 may correspond to FIG. 2, except that FIG. 10 also includes first and second vias 1000*a*, 1000*b*, that extend through the substrate 200. First and second conductors 1010*a*, 1010*b* also are provided, that extend through the vias 1000*a*, 1000*b*. The first conductor 1010*a* is electrically connected to the first contact 240*a*, for example through the hinge and/or using other conventional electrical connections. The second conductor 1010*b* is electrically connected to the second contact 240*b*. It will be understood by those having skill in the art that, in FIG. 10, the first and second conductors 1010*a*, 1010*b* are shown as filling the respective vias 1000*a*, 1000*b*. However, in other embodiments, the first and second conductors 1010*a*, 1010*b* need not fill the entire via 1000*a*, 1000*b*. It also will be understood that at least one via and at least one conductor may be provided in the substrate 200 in embodiments of FIGS. 3-7.

Figure 11:
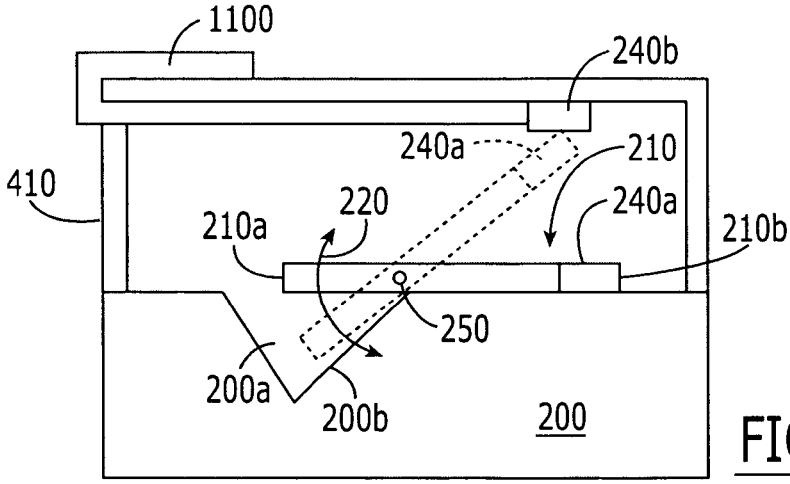

FIG. 11 is a cross-sectional view of other embodiments of the present invention. Embodiments of FIG. 11 may correspond to embodiments of FIG. 4, except that an external contact is provided for the magnetic switch on the cap 410. In particular, as shown in FIG. 11, a conductor 1100 is provided that is connected to the second connector 240*b*, and extends from an inner surface of the cap 410 to an outer surface of the cap 410, to provide an external contact for the magnetic switch on the cap 410. It will be understood that, in other embodiments, conductor 1110 may extend through a via in the cap 410 adjacent the second contact 240*b*. The conductor 1100 may be formed using conventional screening, plating and/or other conventional techniques for selectively metallizing a cap. It also will be understood that conductors 1100 may be used with embodiments of FIGS. 5, 8 and/or 9. Moreover, combinations of embodiments of FIGS. 10 and 11 may be used to provide external contacts for the magnetic switch on the substrate and on the cap. Accordingly, many different configurations of external contacts may be provided.

Figure 12A:
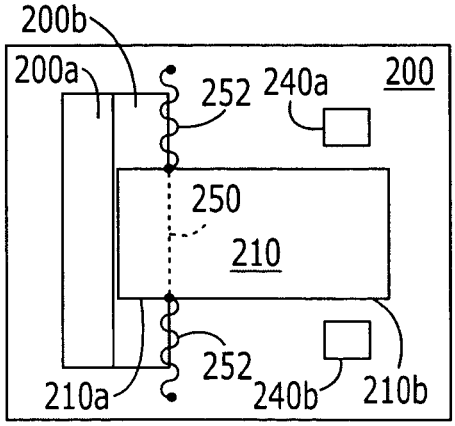
FIGS. 12A-12B and 13A-13B are top plan views of magnetic switches according to various embodiments of the present invention.
Figure 12B:
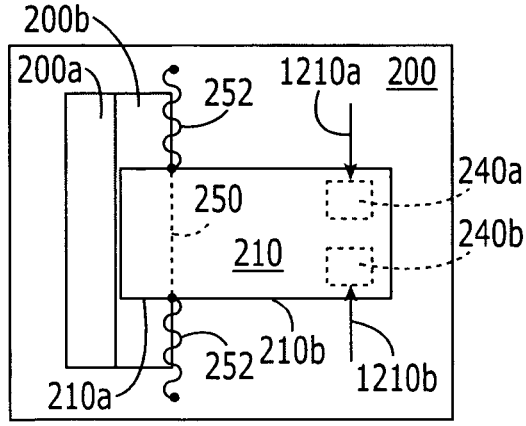

FIGS. 12A and 12B are top plan views of magnetic switches according to other embodiments of the present invention. These embodiments may correspond to embodiments of FIG. 6, but illustrate how the contacts 240*a*, 240*b* may be configured to move during fabrication of the magnetic sensor. In particular, referring to FIG. 12A, the contacts 240*a*, 240*b* may be fabricated from the same layer as the rotor 210 and/or the hinges 252, and may thereby be outside the head portion 210*b* of the rotor 210. As shown in FIG. 12B, forces may be applied in the direction shown by arrows 1210*a*, 1210*b*, to move the first and/or second contacts 240*a*, 240*b* beneath the head portion 210*b*. The forces 1210*a*, 1210*b* may be provided by mechanical probes, by an actuator that is on the substrate 200 and/or using other techniques. In some embodiments, the contacts, and/or an element connected thereto, are configured to inelastically deform, so that the contacts remain beneath the rotor. It will be understood that embodiments of FIGS. 12A and 12B also may be applied to embodiments of FIGS. 2, 3, 6 and/or 7 with respect to the head and/or tail portions of the rotor.

As was described above, in some embodiments of FIGS. 12A and 12B, the first and/or second contacts are configured to inelastically deform, to move beneath the head portion 210*b* and remain beneath the head portion 210*b*.

In some embodiments of the invention, the forces 1210*a*, 1210*b* may be provided by actuators that are provided on the substrate 200. Actuators according to some embodiments of the present invention may be provided by a thermal arched beam actuator as described, for example, in U.S. Pat. No. 5,909,078 to Wood et al., entitled Thermal Arched Beam Microelectromechanical Actuators, the disclosure of which is hereby incorporated herein by reference in its entirety as if set forth fully herein. In other embodiments, an actuator may be provided that uses one or more beam members that are responsive to temperature as described, for example, in U.S. Pat. No. 6,407,478, entitled Switches and Switching Arrays That Use Microelectromechanical Devices Having One or More Beam Members That Are Responsive To Temperature, the disclosure of which is hereby incorporated herein by reference in its entirety as if set forth fully herein. As noted in the '478 patent, these beam members that are responsive to temperature also may be referred to as "heatuators". Other actuators also may be used.

Figure 13A:
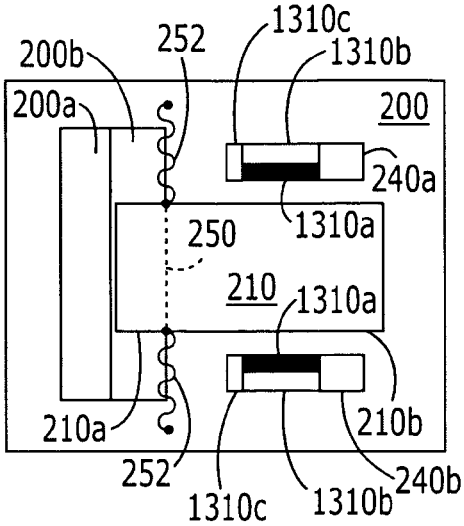
Figure 13B:
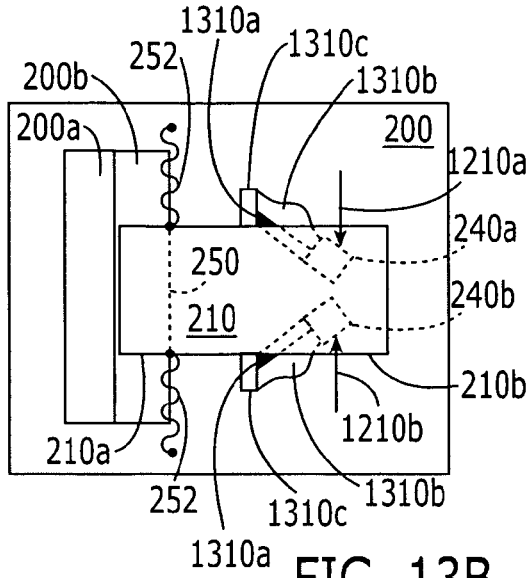

FIGS. 13A and 13B illustrate embodiments of the invention that may use heatuators and/or other inelastically deformable beams to move the first and/or second contacts from outside the rotor to beneath the rotor. In particular, as shown in FIG. 13A, first and second beams 1310*a*, 1310*b* are provided, having fixed ends 1310*c* and movable ends that are connected to the first or second contact 240*a*, 240*b*. As also shown in FIG. 13A, the second beams 1310*b* are thinner than the first beams 1310*a*. Thus, as shown in FIG. 13B, upon application of heat such as current through the beams, the second beams 1310*b* inelastically deform to cause the first and second contacts to move beneath the rotor in the direction shown by arrows 1210*a*, 1210*b*. The design of heatuator structures are well known to those having skill in the art and need not be described further herein. Other deflectable/deformable beam structures may be used in other embodiments of the present invention.

Figure 22B:
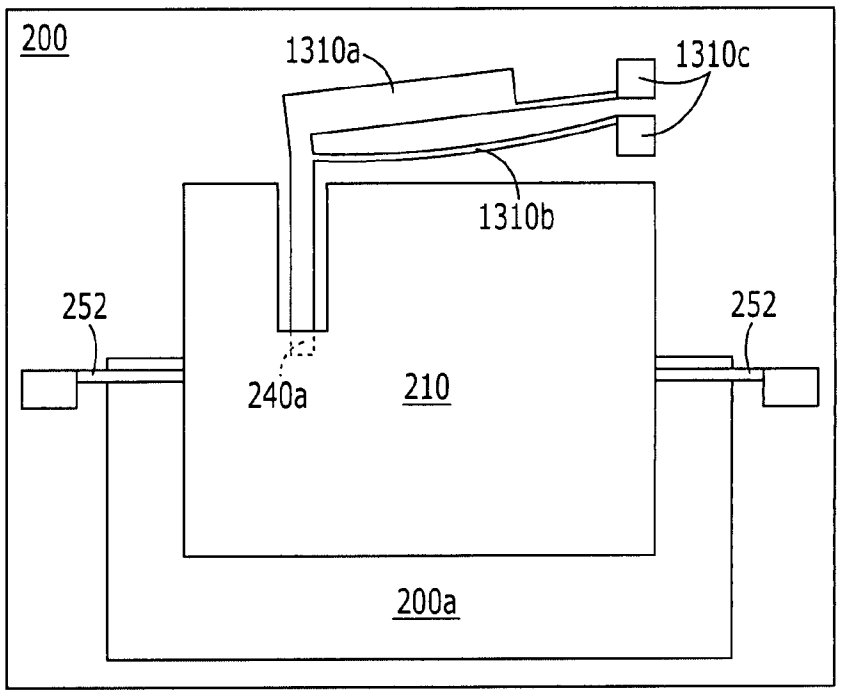
FIGS. 22A and 22B are top plan views of magnetic switches according to other embodiments of the present invention.
Figure 22A:
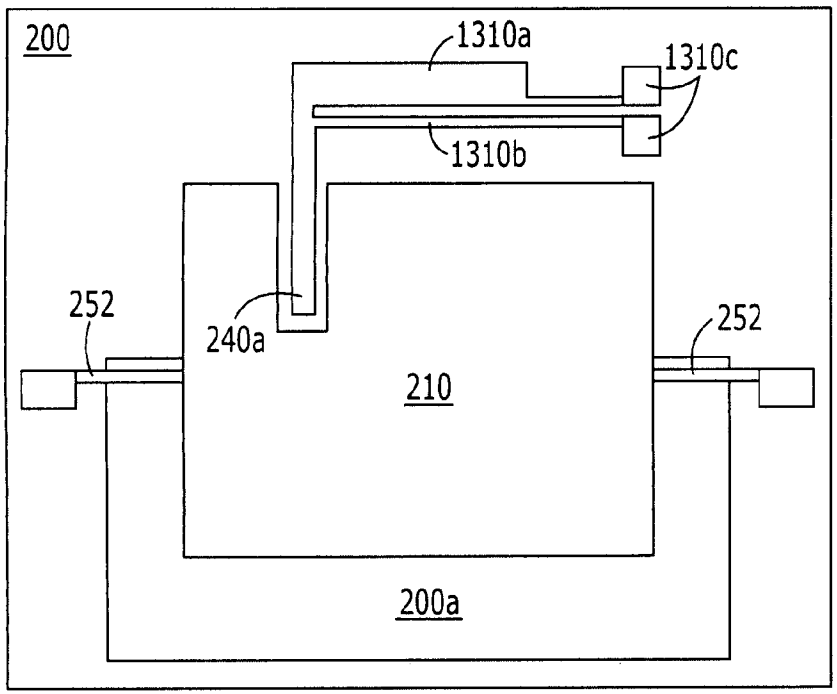

FIGS. 22A and 22B illustrates other embodiments of the invention that may use heatuators and/or other inelastically deformable beams, to move the contacts from outside the rotor to beneath the rotor. In FIG. 22A, after current exceeding a certain value is applied between the pads 1310*c* for a short duration while the rotor 210 is tilted into the trench 200*b*, the heatuator permanently deforms and the contact tip 240*a* slides under the rotor 210.

Figure 23B:
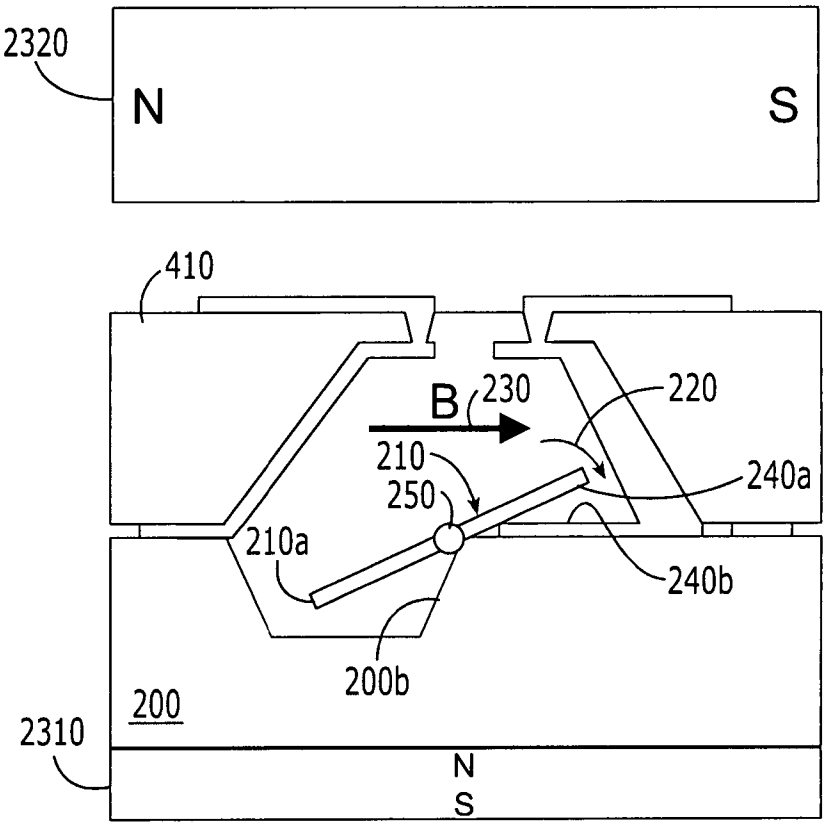
FIGS. 23A and 23B are cross-sectional views of magnetic switches according to other embodiments of the present invention.
Figure 23A:
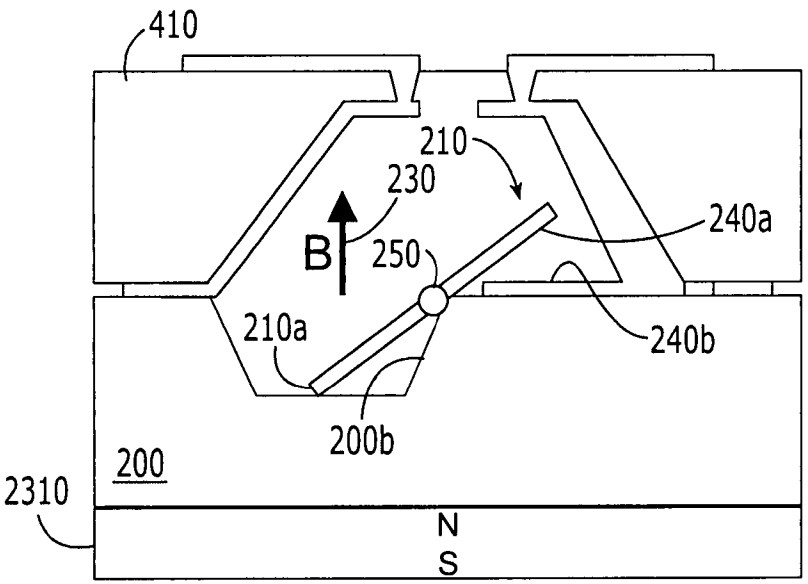

FIGS. 23A and 23B are cross-sectional views of magnetic switches according to other embodiments of the present invention. These embodiments employ a permanent magnet 2310. Embodiments of FIGS. 23A and 23B can provide a normally open switch with a permanent magnetic layer. Normally closed switches also may be provided. The permanent magnet 2310 can comprise an electroplated or screen printed permanent magnet layer and/or other conventional permanent magnets. As shown in FIGS. 23A and 23B, this layer is magnetized orthogonal to the substrate 200 and generates a constant magnetic field, shown at 230 in FIG. 23A, that maintains the rotor 210 in a predetermined position, shown as the open position in FIG. 23A.

As shown in FIG. 23B, upon application of the changed magnetic field, such as caused by a second magnet 2320, the rotor 210 is configured to rotate from the predetermined position shown in FIG. 23 in response to the changed magnetic field indicated by 230 in FIG. 23B. Thus, in FIG. 23B, the switch is closed upon insertion of the switch in a magnetic field parallel to the substrate 200. In some embodiments, this field is stronger than the field from the permanent magnet 2310.

Figure 24B:
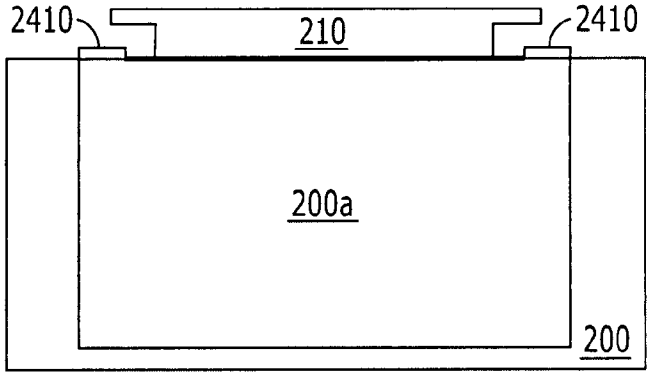
FIGS. 24B and 24C are cross-sectional views taken along the line A-A of FIG. 24A during operation of the switch of FIG. 24A.
Figure 24C:
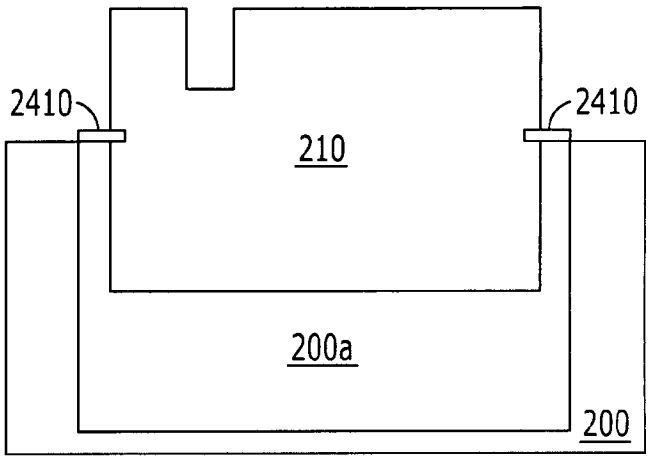
Figure 24A:
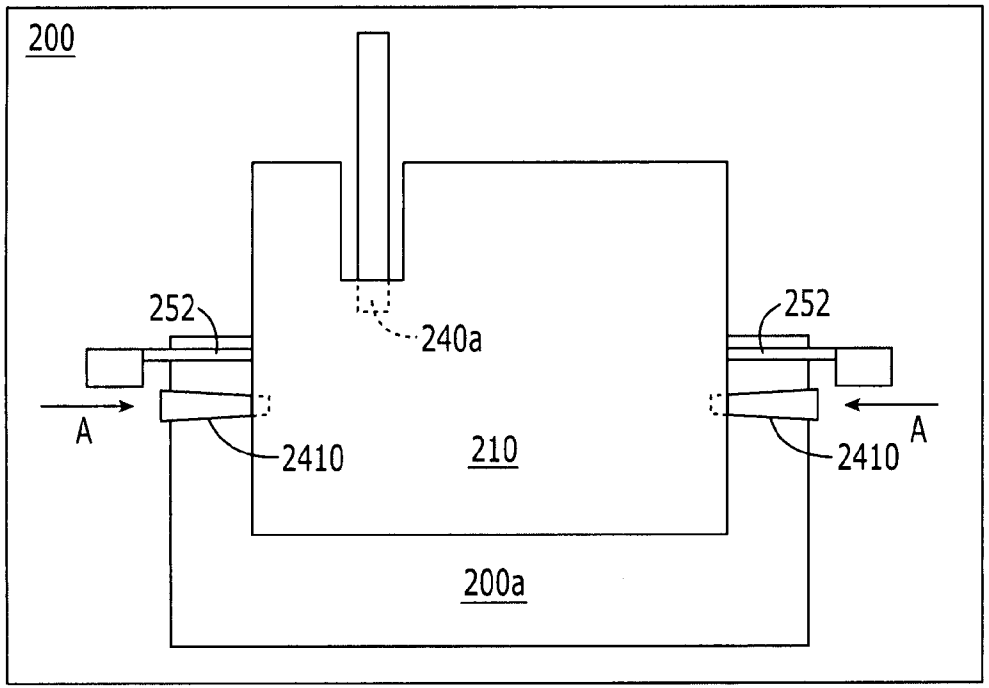
FIG. 24A is a top plan view of a magnetic switch according to other embodiments of the present invention.

FIGS. 24A-24C illustrate other embodiments of the present invention, wherein a latch is provided that is configured to maintain the rotor such that the first and second contacts continue to make or break electrical connection between one another. A bistable switch may thereby be provided. More specifically, as shown in FIG. 24A, a latch, which may comprise a snapping or flexible tether 2410, overlaps with the rotor 210. As shown in FIGS. 24B and 24C, as the rotor rotates, the flexible tethers 2410 bend down and snap above the rotor 210, thereby holding the rotor up at a distance from the contact 240*a*. A horizontal magnetic field can overcome the tethers 2410, and return the switch to its closed state. Bistable switches thereby may be provided.

Figure 14:
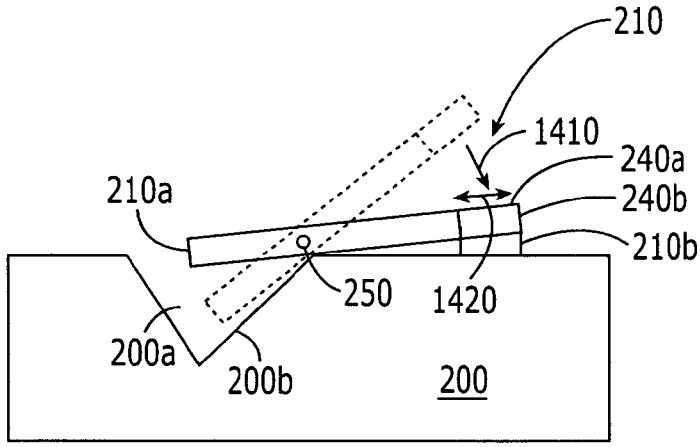
FIG. 14 is a cross-sectional view of a magnetic switch according to various embodiments of the present invention.

FIG. 14 is a cross-sectional view of other embodiments of the present invention. Embodiments of FIG. 14 may be similar to embodiments of FIG. 2, except embodiments of FIG. 14 illustrate that the rotor is configured to rotate the tail in the recess and to wipe a contact in response to the changed magnetic field. In particular, as shown in FIG. 14, upon movement of the rotor 210 clockwise in the direction shown by arrow 1410, to hit the contact 240*b*, the momentum of the rotor combined with the flexibility of the hinge can cause the rotor to continue moving laterally to the right in FIG. 14, and then back to its equilibrium position, as shown by arrow 1420, to thereby cause a rubbing or wiping action across the contact 240*b*. This wiping action can increase the reliability of magnetic switches according to some embodiments of the present invention. It also will be understood that wiping action according to embodiments of the present invention may be provided in any of the embodiments described in FIGS. 1-13B.

Figure 15:
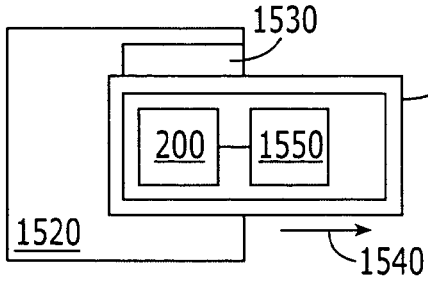
FIG. 15 is a conceptual view of an encapsulated magnetic switch in a removable housing according to various embodiments of the present invention.

FIG. 15 is a cross-sectional view of magnetic switches according to other embodiments of the present invention. As shown in FIG. 15, a magnetic switch, including a substrate 200 and other elements described above, according to any of the embodiments that were described in connection with FIGS. 1-14, is provided. A housing 1520 also is provided including a permanent magnet 1530 that is coupled to the housing 1520. The magnetic switch including the substrate 200 is removably coupled to the housing 1520 and configured such that removal of the magnetic switch from the housing 1520, as shown by arrow 1540, causes the first and second contacts to electrically connect to and/or electrically disconnect from one another. In other embodiments, an electrical device 1550, such as a camera, detector, processor, storage device, battery and/or other electrical device is electrically connected to the magnetic switch by electrical connection to the first and/or second contacts, and is configured to become operative upon a first or second contact electrically connecting to and/or electrically disconnecting from one another. In still other embodiments, an encapsulating structure 1510 may be provided, wherein the substrate 200 and the electrical device 1550 are encapsulated by the encapsulating structure 1510. Accordingly, embodiments of FIG. 15 can allow a magnetic switch and an electrical device to be encapsulated and activated upon removal of the encapsulated structure from the housing 1520.

FIGS. 2-15 also illustrate methods of fabricating a magnetic switch according to embodiments of the present invention. According to some embodiments of the present invention, a magnetic switch may be fabricated by forming on a substrate, a rotor comprising ferromagnetic material and including a tail portion and a head portion at opposite ends thereof and a contact that is outside the rotor, as illustrated, for example, at FIGS. 12A or 13A. A recess is formed in the substrate beneath the tail portion, as also shown in FIGS. 12A and 13A. In some embodiments, the recess is fabricated after forming the rotor and/or other structures. In other embodiments, the recess is fabricated before forming the rotor, such that the tail portion is formed above the recess. Then, the contact(s) that is outside the rotor is moved to beneath the rotor as shown, for example, in FIGS. 12B and 13B. In some embodiments, the tail is rotated into the recess, as shown in FIGS. 2-5, to provide a gap between the head portion and the substrate, and then the contact(s) is moved along the substrate into the gap between the head portion and the substrate. In other methods, a cap may be placed on the substrate as was shown, for example, in FIGS. 4, 5, 8, 9 and 11. In still other embodiments, a via is formed that extends through the substrate and a conductor is formed that extends through the via, to provide an external contact for the magnetic switch on the substrate, as was illustrated, for example, in FIG. 10. In still other embodiments, as is illustrated in FIG. 15, an electrical device is connected to the contact and the electrical device and the substrate are encapsulated. The encapsulated substrate and electrical device are removably placed into a housing and, for use, are removed from the housing.

In some embodiments of the present invention, the vias and the conductors may be fabricated by masking the backside of the substrate according to a desired via pattern, and then etching through the substrate from the backside using the masking. A KOH etch may be performed. A plating seed layer, such as a Cr/Ni/Ti seed layer, may then be formed on the sidewalls of the vias and on the back face of the substrate, and the vias may then be filled with a conductor by plating nickel and/or gold on the seed layer. The seed layer may then be etched between the vias, lead-tin solder bumps may be formed in the vias.

Additional discussion of other embodiments of the present invention now will be provided. As was described above, magnetic switches according to some embodiments of the invention can be configured for normally closed and/or normally open operations, can have low thresholds of switching magnetic field, can have high shock and vibration reliability, and/or low contact resistance. Embodiments of the invention can utilize torsional forces acting on a ferromagnetic plate element tilted in relation to the magnetic flux lines. Utilizing torsional forces can provide mass-balanced design that can have better shock and/or vibration resistance than comparable reed-like or cantilever-like designs.

As was also described above, in some embodiments, a magnetic switch includes at least one substrate that can be fabricated from semiconductive material, and a ferromagnetic rotor attached to a torsional hinge and/or cantilevers acting like a torsional hinge. Two electrically conductive contacts can define open and closed states of the switch. In some embodiments, one of the contacts is formed on the ferromagnetic rotor. In some embodiments, the second contact is formed on a contact arm that is mechanically moved beneath the rotor after tilting it in relation to the substrate. In other embodiments, the second contact is formed on a cap that can hermetically seal the device, and can provide electrical connections from the switch itself to external pad(s) on the other side of the cap. In some embodiments, the cap may be used to provide initial tilt to the rotor. In some embodiments, mechanical bias of the torsional hinge or cantilevers can determine the contact force and closed state resistance of the normally closed configuration. In some embodiments, the closed state resistance of the normally open configuration may be determined by an applied magnetic field.

As was also described above, other embodiments of the invention can fabricate a magnetic switch. These embodiments can include forming a torsional hinge or cantilevers, interconnect lines, hermetic packaging of the switch, a sacrificial layer, contact surfaces, and/or a ferromagnetic rotor attached to the torsional hinge or cantilevers. In some embodiments, fabrication includes forming a cap from non-conductive or isolated semiconductive material with conductive vias providing electrical interconnects to external pads and a hermetic seal for the moving components of the switch. In other embodiments, a cap can serve only as a hermetic cover and electrical interconnects are formed into the device substrate prior, parallel to and/or after the device fabrication.

Some embodiments of the present invention can make use of micromechanical "pop-up" structures as previously described in U.S. Pat. No. 6,396,975 (Wood et al.) and U.S. patent publication 2002/0171909 A1 (Wood), the disclosures of which are hereby incorporated herein by reference in their entirety as if set forth fully herein. The Wood et al. patent and the Wood patent publication provide optical switches based on magnetically actuated "pop-up" mirrors to redirect light paths within the switch. A plate made of ferromagnetic material such as nickel is fabricated on the surface of a silicon wafer and attached to the wafer through a flexible torsion hinge. A trench on one side of the hinge allows the "tail" of the plate to rotate beneath the plane of the substrate while the "tip" of the plate rotates upward off the wafer surface. A voltage can be applied across a first electrode on the tail and a second electrode on the trench wall to electrostatically latch the reflector in the up position, as noted in Paragraph [0034] of the Wood et al. patent publication. The basic action of these devices is shown in FIG. 16.

Figure 16:
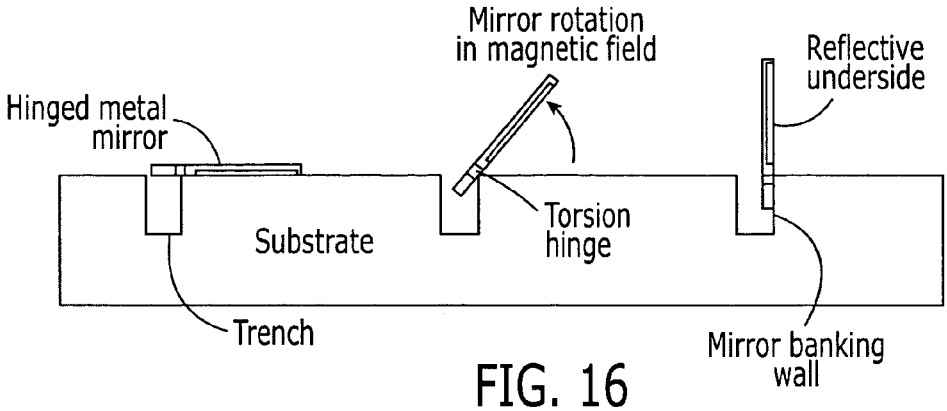
FIG. 16 is a cross-sectional view of a pop-up structure for an optical switch according to U.S. Pat. No. 6,396,975 and U.S. patent Publication 2002/0171909.
Figure 17A:
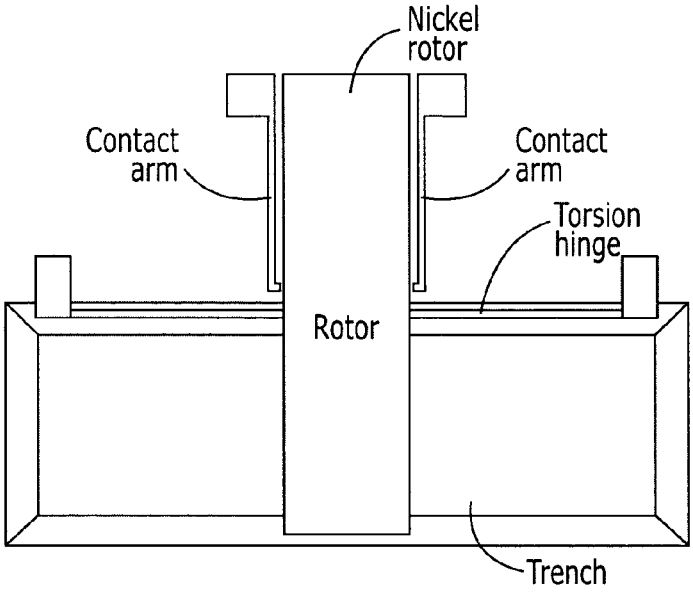
FIGS. 17A-17B are top plan views of magnetic switches according to various embodiments of the present invention, during fabrication thereof, according to various embodiments of the present invention.
Figure 17B:
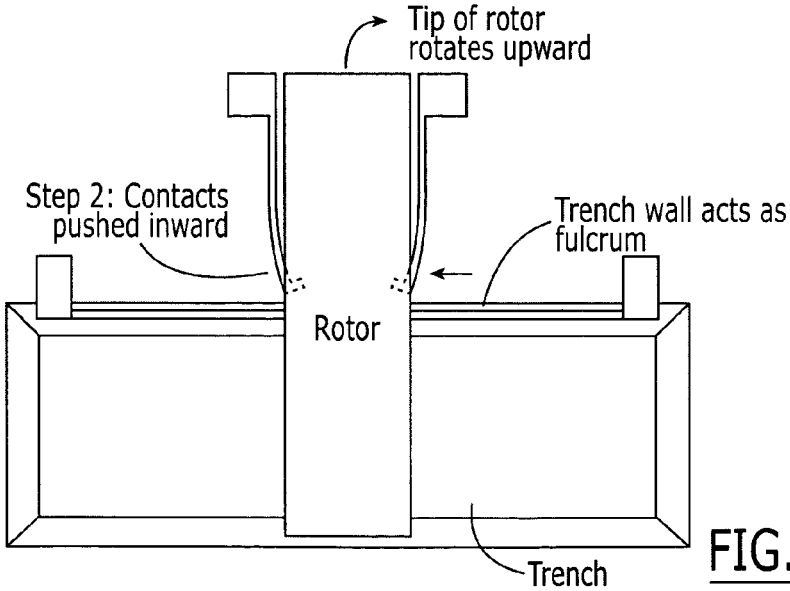

Some embodiments of the invention may arise from recognition that a device of FIG. 16 may be modified to include contacts and contact metallurgy in order to produce a magnetic switch, as shown in FIGS. 17A-17B. In some embodiments of the invention, as shown in FIG. 17A, a rotor plate is provided comprising one or more layers of ferromagnetic materials such as electroplated nickel, permalloy and/or other magnetic alloys. The rotor is connected to the substrate via an elastic torsion hinge, cantilevers and/or other structure comprising silicon nitride, silicon, polysilicon, silicon oxide and/or similar suitable material. In some embodiments, as shown in FIG. 17A, to form a switch contact, slender contact arms are co-fabricated on both sides or in the center of the rotor tip.

Figure 18A:
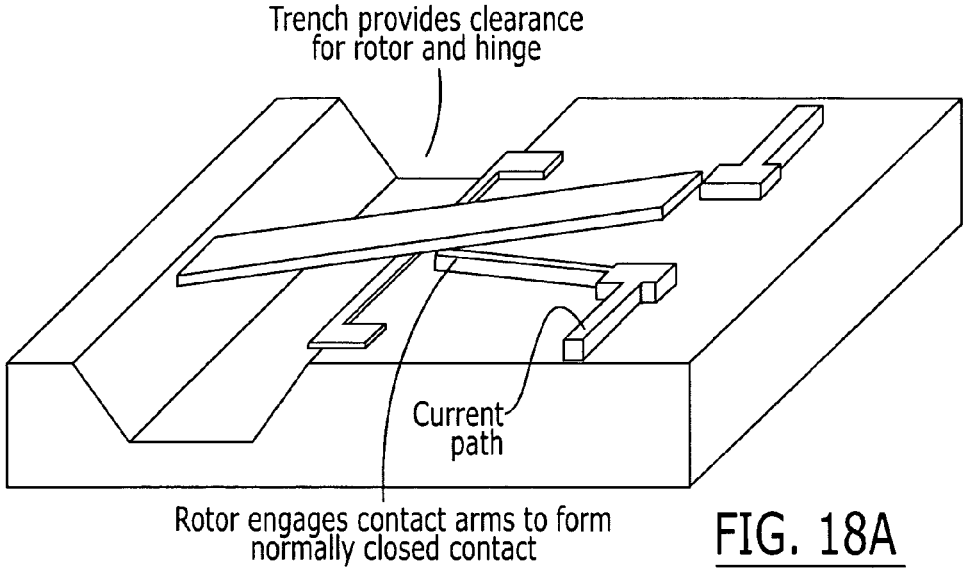
FIGS. 18A-18B are perspective views of magnetic switches according to various embodiments of the present invention.
Figure 18B:
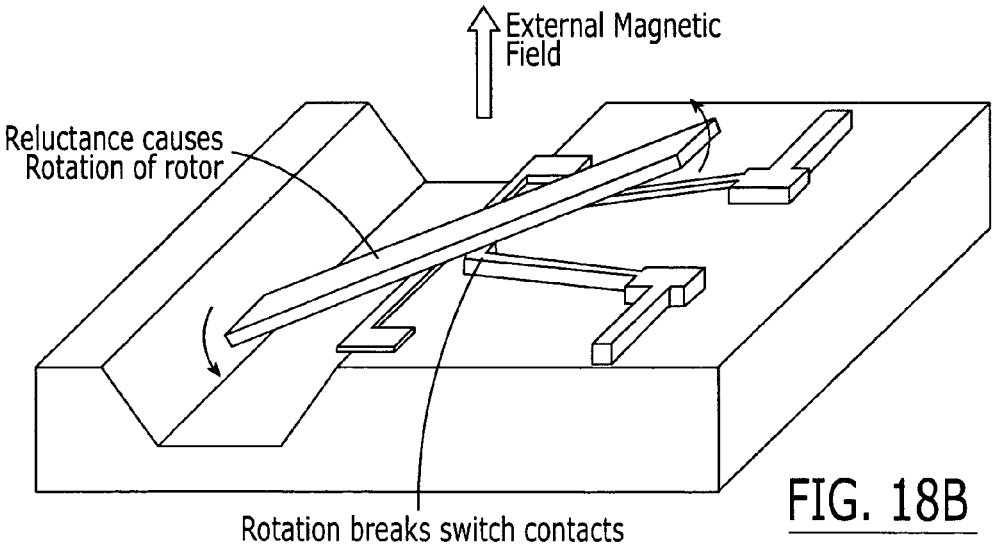

In some embodiments, as shown in FIG. 17B, using an automated robotic assembly process, these contact arms are mechanically bent under the rotor to allow contact with the rotor tip in its rest position and/or to provide the hinge with mechanical bias for switch closure. To facilitate the arm-bending process, the rotor tail is pushed downward, rotating the mirror tip upward and out of the way. A trench beneath the rotor tail provides clearance for the rotor tail as it is pushed down. The trench edge acts as a fulcrum or axis for rotation of the rotor. The contact arms remain in the bent position due to plastic deformation of the nickel. The arms may be configured to control the bending action and limit their bending mode to the substrate plane. Suitable mechanical "stops" and latches can be employed to limit the amount of bending of the contact arms during robotic assembly. FIGS. 18A-18B are perspective views of different embodiments of the mechanically microassembled contact arms, after assembly and during actuation, respectively.

In some embodiments of the invention, restoring force produced by the elastic hinge brings the bottom surface of the rotor into contact with the upper surface of the contact arms. These surfaces may be coated with a noble metal such as gold, platinum and/or rhodium in order to produce a suitable electrical contact. Contact force may be determined through a combination of hinge elasticity, angular bias of the rotor at its new rest position, and/or distance of switch arms from the hinge rotational axis.

As shown in FIG. 18B, in some embodiments, the switch is actuated by applying a local magnetic field with its flux lines oriented perpendicular to the substrate. The field produces torque on the rotor due to the tendency of the rotor to orient its long axis with the magnetic lines of force. A rotor that is perfectly perpendicular to the field lines may not be compelled to rotate in a particular direction, since either clockwise or anticlockwise rotation will align the mirror to the field lines. However, because of the placement of the trench and the counterclockwise rotational bias imposed by the contact arms, the device in FIG. 18B can rotate preferentially in the counterclockwise direction. The rotor plate may also be made asymmetrical with respect to the hinge axis, i.e., the section that rotates upward can be longer than the section that rotates downward. This can cause the rotor to rotate upwardly preferentially. With sufficiently strong field, rotation takes the rotor out of contact with the contact arms, interrupting the circuit and opening the switch. When the magnetic field is removed, the restoring force produced by the hinge brings the rotor back into contact with the contact arms, completing the circuit once again.

Embodiments of the present invention can make use of the reluctance effect, i.e., the torque produced is due to lowest-energy alignment of a ferromagnetic plate in a uniform field. Using soft magnetic materials such as Permalloy (80/20 NiFe alloy) can make this effect independent of the polarity of magnetic field. In other embodiments, it is also possible to employ a remnant field effect, i.e., to permanently magnetize the plate with a North and South Pole, and/or by electrodepositing an array of poles with their fields oriented perpendicular to the substrate. This could be done, for example, by electroplating the plate or array of poles in a suitable magnetic field, and/or by magnetizing the plate/poles after fabrication. A remnant field rotor may produce higher torque-that could be exploited to produce a more compact device, higher closure force, and/or greater sensitivity to the applied external magnetic field. However, devices utilizing remnant field effect may operate only with one polarity of magnetic field.

The embodiments of FIGS. 18A-18B show a "shorting bar" style of switch, i.e., a broken circuit that is closed at two points of contact by the rotor. It will be appreciated by those skilled in the art that other switch types, including those that use one point of contact, may be constructed according to other embodiments of the invention.

Other embodiments of the invention can provide Normally Closed MEMS Magnetic Switch (NCMS) which can have high contact force provided by a mechanically biased torsional hinge or cantilevers, which can be microassembled and tested on fully automated probe station before packaging, and/or which can be mechanically biased during packaging. Low contact resistance can be provided in the closed state due to the high contact force and use of noble highly conductive non-corrosive metals such as gold, platinum, palladium, and/or rhodium for contact surfaces. Some embodiments can provide torsional hinges or cantilevers made of silicon nitride that can be about 10 times stronger than steel and can have little or no creep to provide performance over, for example, billions of cycles.

Other embodiments can provide wiping action closure as a self-cleaning mechanism. The wiping action can come from the complex motion of the rotor during the closure. First, the rotor turns around the hinge axis. Then, it hits the contact point located close to the initial axis of rotation (relative to the rotor size) and starts rotating around the contact point. Finally, it comes to the rest position that is determined by rotor friction at the contact point, hinge torque, and hinge bending in planes normal and parallel to the rotor. This motion can result in a desirable wiping action. Other embodiments can provide mechanically balanced moving components and mechanically biased torsional springs to reduce or minimize shock and vibration sensitivity and to reduce or eliminate bouncing of the switch after closure.

Embodiments of the invention can be used as a SPST switch, a DPST switch and/or Multiple Pole-Single Throw configurations. SPDT, DPDT and/or Single Pole-Multiple Throw configurations also may be provided. Double or multiple poles may be provided by arraying single pole configurations, by providing multiple isolated contacts on a rotor, by providing a split rotor on a common hinge and/or by other techniques.

Figure 25A:
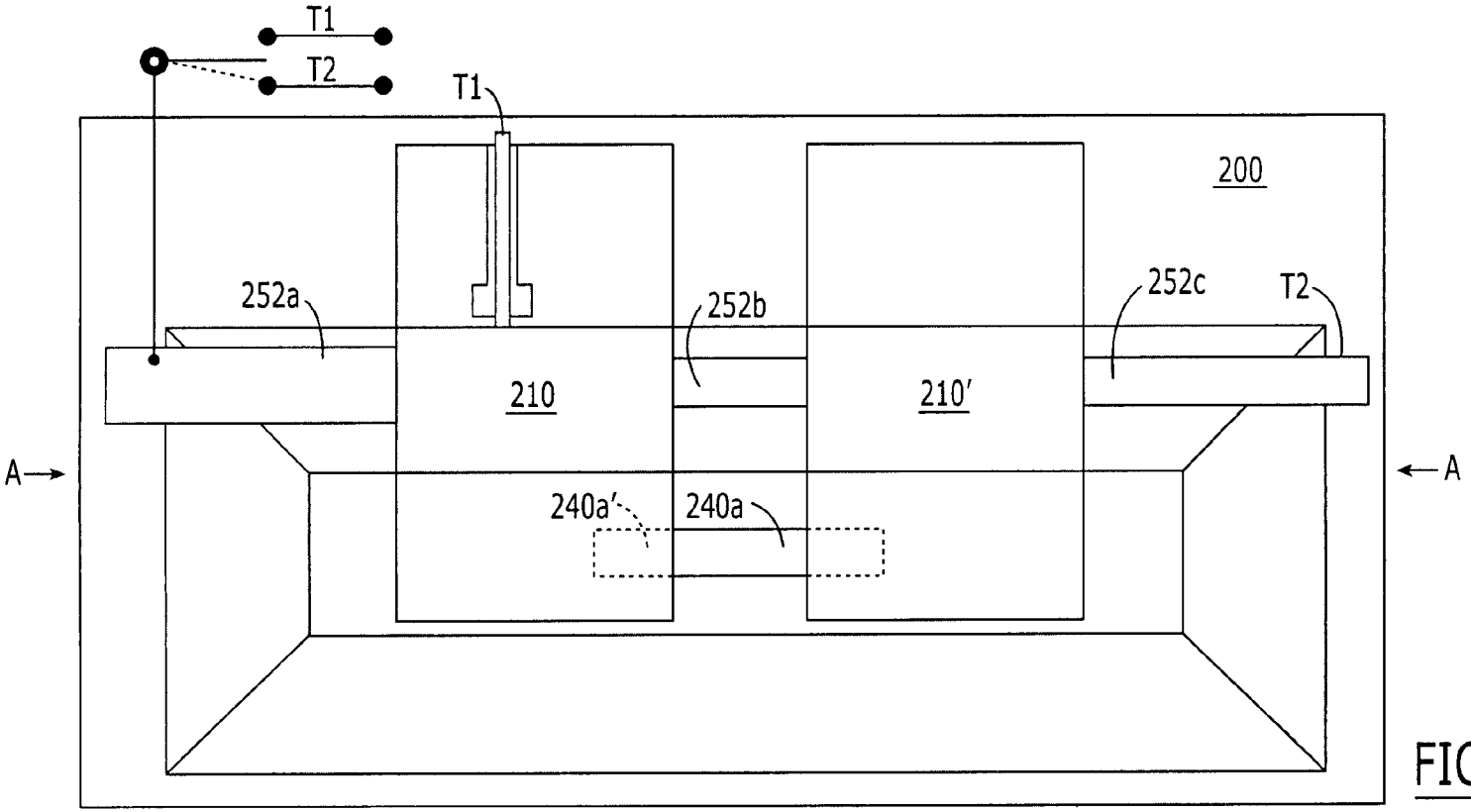
FIG. 25A is a top plan view of a magnetic switch according to other embodiments of the present invention.
Figure 25C:
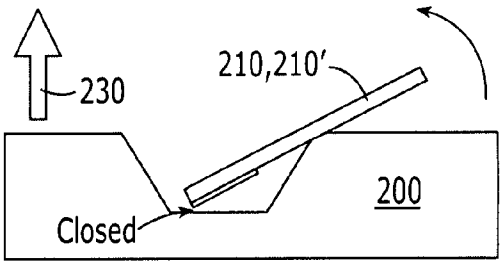
FIGS. 25B and 25C are cross-sectional views taken along the line A-A of FIG. 25A during operation of the switch of FIG. 25A.
Figure 25B:
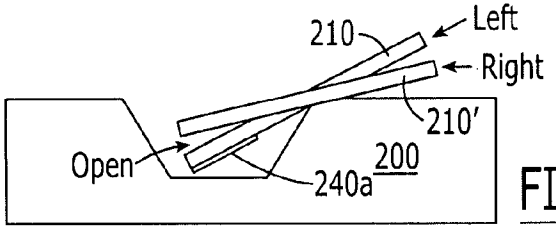

For example, referring to FIGS. 25A-25C, SPDT or normally open magnetic switches may be provided, wherein the rotor is divided into two parts 210, 210' that may be connected by a nitride or other insulating common hinge 252*b* that does not include interconnecting metal. Alternatively, the two rotors 210, 210' can be mechanically independent and pre-tilted individually. One of the rotors 210 can have a stiffer outer hinge 252*a* than the other hinge 252*c* and can have a contact flap 240*a* under the tail part. The flap can be anchored at 240*a'* and can be moved down away from the other rotor after assembly as shown in FIG. 25B. A magnetic field 230 can turn both rotors up as shown in FIG. 25C, but one rotor can go up faster than other due to varying stiffness of the outer hinges 252*a*, 252*c*. Moreover, a "make before break" or "break before make" configuration may be provided, depending on the relative hinge stiffness. Magnetic sensitivity can be determined by the difference in stiffness between the hinges 252*a*, 252*e* and/or the difference in size between the two rotors 210, 210'.

Inexpensive MEMS processing techniques may be used, and, in some embodiments, deep Reactive Ion Etching may not be needed. In some embodiments, performance that can be enhanced or altered by using hard magnetic materials for the rotor instead of soft magnetic nickel or permalloy. Finally, magnetic switches according to embodiments of the invention can be wafer-level chip-scale hermetically packaged in a Surface Mount Technology (SMT)-compatible package suitable for high-volume production.

Normally Open MEMS Magnetic Proximity Switch (NOMPS) also can be provided according to one or more of the mentioned above embodiments. In some embodiments, its resistance in the closed state may be determined by magnetic force pushing the rotor against the contact located on the cap. Normally Open MEMS Magnetic Switch (NOMS) also may be provided, which has a ferromagnetic rotor mass-balanced in relation to weak torsional hinge that can achieve high magnetic sensitivity and can achieve good shock and vibration reliability at the same time.

Magnetic switches according to embodiments of the invention may be used where a small magnetic switch is desired. Because of its potentially small package size and potentially exceptionally low contact resistance, promising applications for the normally closed embodiments may be in battery-powered devices that are activated upon separation from the parent system or a certain object. These devices may be very small and/or they could be in a "sleep" mode, without consuming energy, for a long time. Implantable or other in-vivo medical devices have been mentioned above. Other applications may include underwater devices, space satellites, structural monitoring systems utilizing multiple sensors for detection of major cracks or movements of the structural elements of buildings, bridges, etc. due to overload or earthquakes.

Figure 19B:
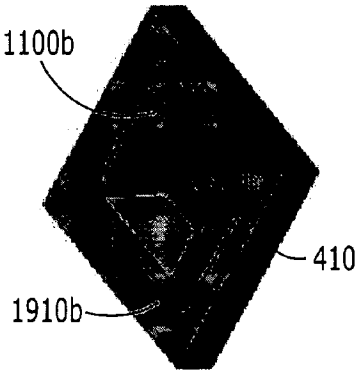
FIG. 19A is a top view of a magnetic switch and FIG. 19B is a perspective of a mating cap, according to various embodiments of the present invention.

In other embodiments, the contact arm may be bent by passing current through it. This "heatuator" design was described in the U.S. Pat. No. 6,407,478. Embodiments shown in FIG. 19 can use plastic deformation resulting from heating asymmetric shapes with electric current.

Figure 19A:
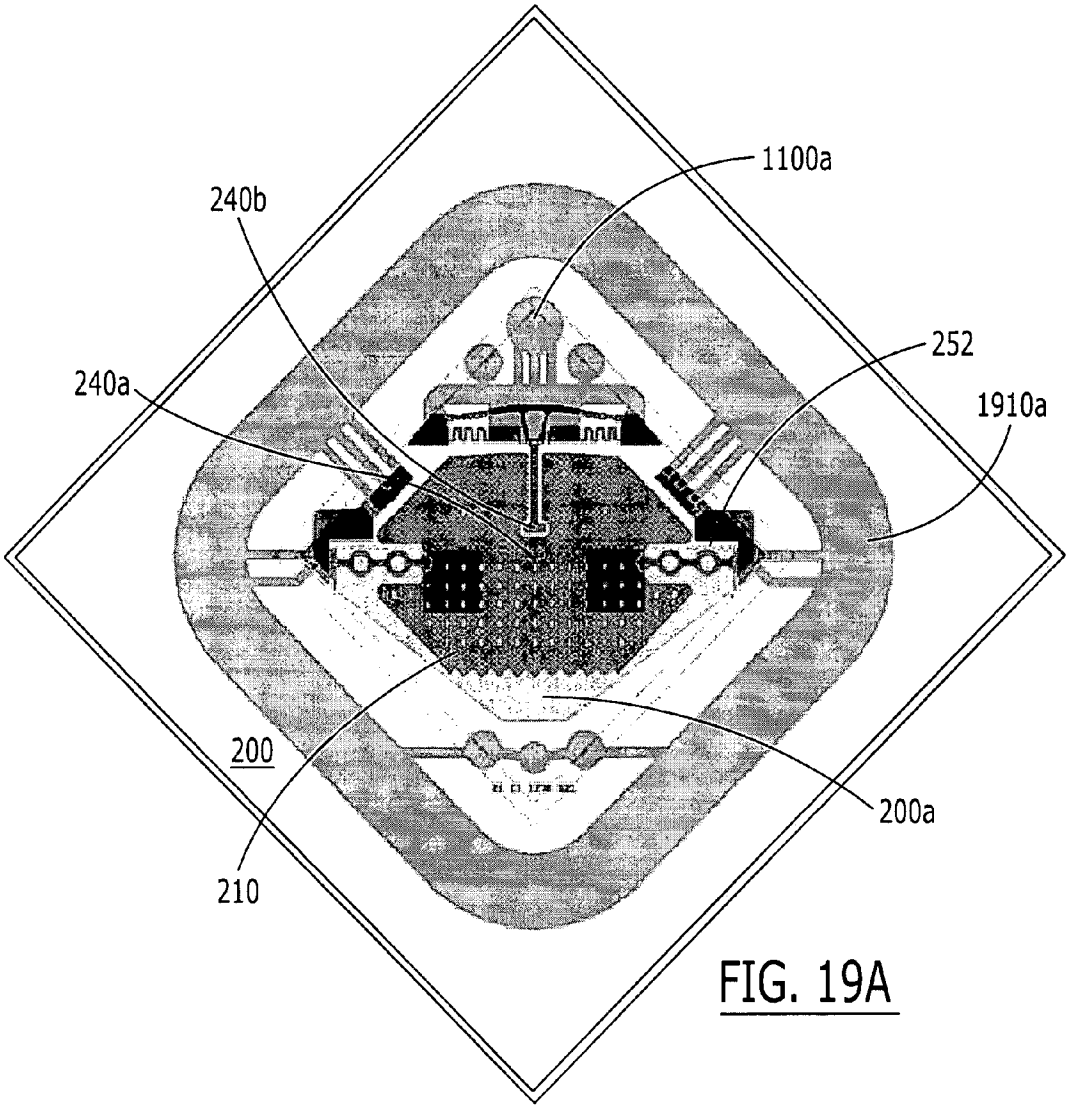

FIG. 19A is a top view of magnetic switch layouts according to various embodiments of the present invention. A rotor 210, a first contact 240*a*, a second contact 240*b* and trench 200*a* are shown. The first contact 240*a* is electrically connected to a seal ring 1910*a* on the substrate which can mate with a seal ring 1910*b* on a cap 410. The second contact 240*b* is electrically connected to a contact pad 1100*a*, which can mate with the contact pad 1100*b* on the cap 410. The cap 410 of FIG. 19B can be mounted on the substrate 210 of FIG. 19A. In some embodiments, the cap 410*a* of FIG. 19B may include one or more through-holes as described in U.S. patent application Publication No. 2003/0071283, published Apr. 17, 2003, entitled Semiconductor Structure With One or More Through-Holes. However, many other configurations of caps may be provided, as was already described.

Other embodiments of the present invention can make use of existing Chip-Scale, Chip-on-Flex, and TAB (Tape Automated Bonding) Packaging approaches to develop non-hermetic packaging of MEMS devices with low I/O count. These embodiments may be especially suitable for MEMS devices with "pop-up" elements that can raise about 100-500 μm above the silicon level. Some embodiments can use a magnetically actuated microelectromechanical magnetic switch as described above. Other embodiments can be used to package other MEMS devices.

Embodiments of FIGS. 18A-18B can provide a Normally-Closed (NC) MEMS magnetic switch as was described above. A device shown in FIG. 10 can be about 1.5×2.0 mm in size in some embodiments, and its rotor's upper end can be as high as about 200 μm above the surface of the substrate and contact pads. According to some embodiments of the invention, it may be packaged in an SMT-compatible package with maximum footprint of 2×3 mm. There may be two contact pads on the substrate.

Figure 20A:
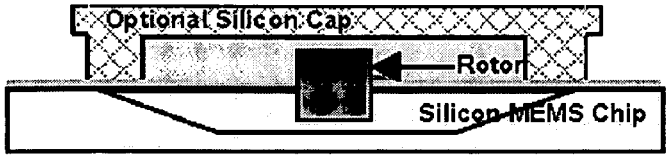
FIGS. 20A-20D are cross-sectional views of packaging of magnetic switches according to various embodiments of the present invention.

A packaging sequence according to some embodiments of the invention is described in FIGS. 20A-20D. As shown in FIG. 20A, a Known Good Die (KGD) is covered by an optional thermally oxidized silicon cap. The cap is picked up by a standard vacuum tool, then it touches 1-2 mils thick adhesive, then mounted on the chip as shown in FIG. 20A. The optional silicon cap is used to protect the MEMS chip and to pick it up. An alternative might involve usage of miniature spring-loaded suction caps.

Figure 20B:
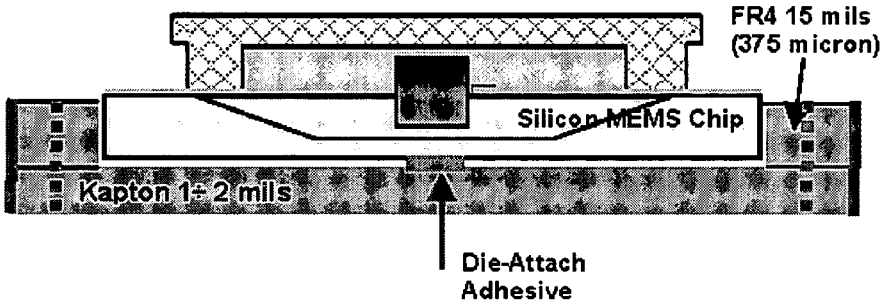

As shown in FIG. 20B, the MEMS chip is attached to a bottom rigid flex board by a single drop of adhesive in the center. The bottom board has through-plated ¼ or ½ vias and may be made by laminating about 16 mils FR4 board to Kapton flex. The top surface of the chip should be about 1 mil higher than FR4.

Figure 20C:
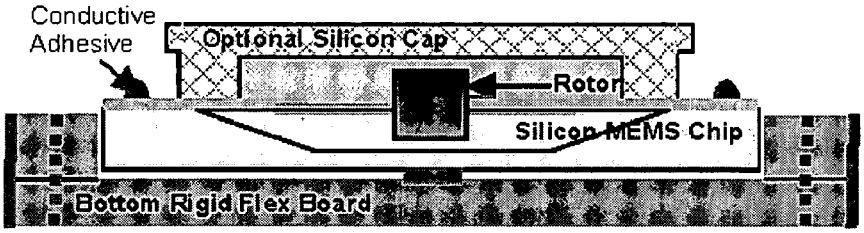

As shown in FIG. 20C, a bead or drops of conductive adhesive is deposited along the edges of the chip on the gold contact pads.

Figure 20D:
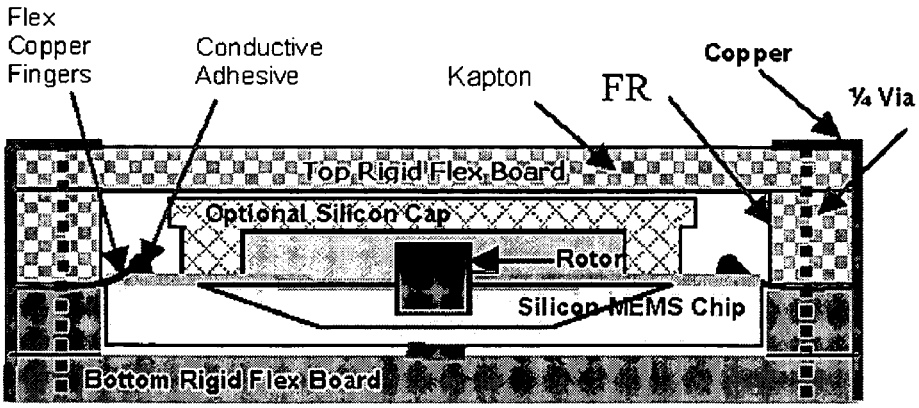

Finally, as shown in FIG. 20D, the top board is attached (laminated) on the top. It includes (top to bottom): copper pads; Kapton or thin FR4 board (if the optional silicon cap is not used); thick, 1 kFR4 (8-16 mils); copper flex fingers (similar to TAB contacts) coated with adhesive on the bottom side; plated through ¼ vias or ½ vias; and copper can be coated by immersion gold.

Figure 21:
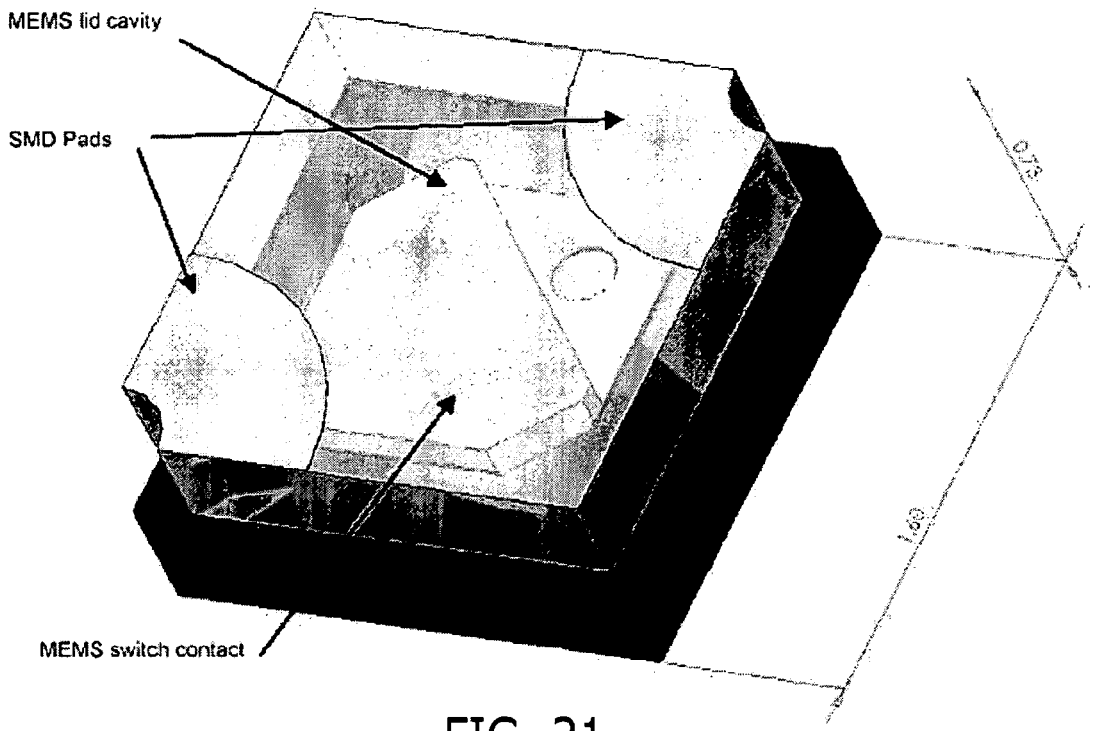
FIG. 21 is a perspective view of a packaged magnetic switch according to various embodiments of the present invention.

FIG. 21 shows the profile and the top view of the section of a silicon cap wafer. In FIG. 21, the cap is shown as semi-transparent to show the internal features. Some embodiments may provide a packaged component of 1.6×1.6×0.8 mm. Front-end processes may increase dimensions up to 0.2 mm.

As shown in FIG. 21, routing from the MEMS contact points can be made through the 2-layer L TCC ceramic lid. Soldering/interconnection pad coplanarity can be provided by standard LTCC process well below SMD requirements. Both solder pads have sidewall metallization, so visual solder meniscus can be visually inspected as for most SMT components. Component delivery may be on industry standard tape and reel. The metal sealing ring (200 um width) assembly process can be dry-flux/flux-less. The cavity is dry air or neutral gas filled to provide both low dew point and high reliability of MEMS over time. The failure mode may be contact damage/subsequent sticking. An arc constraining gas may not be needed due to low current and voltage conditions along with the number of cycles in operation of the switch. MEMS assembly may be done with lid arrays. Dicing/die separation may occur after the device has been sealed, which can offer the high cleanliness inside the device cavity.

In the drawings and specification, there have been disclosed embodiments of the invention and, although specific terms are employed, they are used in a generic and descriptive sense only and not for purposes of limitation, the scope of the invention being set forth in the following claims.

What is claimed is:

1. A magnetic switch comprising:

a substrate including therein a recess;

a rotor that includes a tail portion that overlies the recess and a head portion that extends on the substrate outside the recess, the rotor comprising unmagnetized ferromagnetic material, being configured to rotate the tail in the recess in response to a changed magnetic field and the rotor being balanced in relation to a torsional hinge used to mount the rotor to the substrate;

first and second magnetic switch contacts that are configured to make or break electrical connection between one another in response to rotation of the tail in the recess in response to the changed magnetic field, and at least one deformable beam having a fixed end attached to the substrate and a movable end extending beneath the head portion to allow for contact with the head portion in its rest position and/or to provide the torsional hinge with mechanical bias.

2. A magnetic switch according to claim 1 wherein the torsional hinge defines an axis about which the tail is configured to rotate in the recess in response to the changed magnetic field, and wherein the torsional hinge is prestressed during a mechanical assembly process that provides an initial tilt to the rotor.

3. A magnetic switch according to claim 2 wherein the recess includes a wall that intersects with the substrate at the axis.

4. A magnetic switch according to claim 1 wherein the first contact is on the head portion and the second contact is on the substrate adjacent the head portion.

5. A magnetic switch according to claim 1 wherein the first contact is on the tail portion and the second contact is in the recess adjacent the tail portion.

6. A magnetic switch according to claim 1 further comprising a cap on the substrate that is spaced apart from the rotor to allow rotation thereof, and wherein the first contact is on the head portion and the second contact is on the cap adjacent the head portion.

7. A magnetic switch according to claim 1 further comprising a cap on the substrate that is spaced apart from the rotor to allow rotation thereof, and wherein the first contact is on the tail portion and the second contact is on the cap adjacent the tail portion.

8. A magnetic switch according to claim 1 wherein the first contact and the second contact are on the substrate adjacent the head portion.

9. A magnetic switch according to claim 1 wherein the first contact and the second contact are in the recess adjacent the tail portion.

10. A magnetic switch according to claim 1 further comprising a cap on the substrate that is spaced apart from the rotor to allow rotation thereof, and wherein the first contact and the second contact are on the cap adjacent the head portion.

11. A magnetic switch according to claim 1 further comprising a cap on the substrate that is spaced apart from the rotor to allow rotation thereof, and wherein the first contact and the second contact are on the cap adjacent the tail portion.

12. A magnetic switch according to claim 4 further comprising:

first and second conductors that extend through the substrate, a respective one of the first and second conductors being electrically connected to a respective one of the first and second contacts, to provide external contacts for the magnetic switch on the substrate.

13. A magnetic switch according to claim 5 further comprising:

first and second conductors that extend through the substrate, a respective one of the first and second conductors being electrically connected to a respective one of the first and second contacts, to provide external contacts for the magnetic switch on the substrate.

14. A magnetic switch according to claim 6 further comprising:

a first conductor that extends through the substrate and is electrically connected to the first contact, to provide an external contact for the magnetic switch on the substrate; and a second conductor on the cap that is electrically connected to the second contact to provide an external contact for the magnetic switch on the cap.

15. A magnetic switch according to claim 7 further comprising:

a first conductor that extends through the substrate and is electrically connected to the first contact, to provide an external contact for the magnetic switch on the substrate; and a second conductor on the cap that is electrically connected to the second contact to provide an external contact for the magnetic switch on the cap.

16. A magnetic switch according to claim 8 further comprising:

first and second conductors that extend through the substrate, a respective one of the first and second conductors being electrically connected to a respective one of the first and second contacts, to provide external contacts for the magnetic switch on the substrate.

17. A magnetic switch according to claim 9 further comprising:

first and second conductors that extend through the substrate, a respective one of the first and second conductors being electrically connected to a respective one of the first and second contacts, to provide external contacts for the magnetic switch on the substrate.

18. A magnetic switch according to claim 10 further comprising first and second electrical conductors on the cap, a respective one of which is electrically connected to a respective one of the first and second contacts, to provide external contacts for the magnetic switch on the cap.

19. A magnetic switch according to claim 11 further comprising first and second electrical conductors on the cap, a respective one of which is electrically connected to a respective one of the first and second contacts, to provide external contacts for the magnetic switch on the cap.

20. A magnetic switch according to claim 1 wherein the first and/or second contacts are on the substrate outside the head portion and are configured to move beneath the head portion.

21. A magnetic switch according to claim 1 wherein at least a portion of the first and/or second contacts are connected to the movable end.

22. A magnetic switch according to claim 1 comprising first and second deformable beams, the movable ends being connected to the first contact, the first and/or second beams being configured to move, upon application of heat thereto, the first contact beneath the head portion.

23. A magnetic switch according to claim 21, wherein the first contact remains beneath the head portion.

24. A magnetic switch according to claim 1, wherein the movable end is connectedto the first contact, and wherein the movable end is configured to move the first contact beneath the head portion.

25. A magnetic switch according to claim 1, wherein the movable end is connected to the first contact and wherein the beam is configured to inelastically deform to move the first contact beneath the head portion and cause the first contact to remain beneath the head portion.

26. A magnetic switch according to claim 20 further comprising an actuator on the substrate that is configured to move the first and/or second contacts beneath the head portion.

27. A magnetic switch according to claim 1 wherein the torsional hinge is configured to provide a small lateral motion to the rotor in addition to rotating the tail in the recess wherein such lateral motion result is in a wiping of the first and/or second contacts in response to the changed magnetic field.

28. A magnetic switch according to claim 1 wherein the rotor is a first rotor, the magnetic switch further comprising:

a second rotor that includes a second tail portion that overlies the recess and a head portion that extends on the substrate outside the recess, the second rotor comprising ferromagnetic material and being configured to rotate the tail in the recess in response to the changed magnetic field.

29. A magnetic switch according to claim 28 further comprising:

a first hinge that is coupled to the first rotor to define an axis about which the tail is configured to rotate in response to the changed magnetic field; and a second hinge that is coupled to the second rotor along the axis, and which is stiffer than the first hinge, such that the first and second rotors rotate at different speeds in response to the changed magnetic field.

30. A magnetic switch according to claim 29 further comprising a common hinge that is coupled between the first and second rotors and extends about the axis.

31. A magnetic switch according to claim 30 wherein the first and second hinges are conductive and the common hinge is insulating.

32. A magnetic switch according to claim 29 wherein the first and second magnetic contacts are configured to provide a complex switching operation, a make-before-break or a break-before make operation in response to rotation of the first and second rotors.

33. A magnetic switch according to claim 1 in combination with:

a housing; and a permanent magnet that is coupled to the housing;

the magnetic switch being removably coupled to the housing and configured such that removal of the magnetic switch from the housing causes the first and second magnetic switch contacts to make or break electrical connection between one another.

34. A magnetic switch according to claim 1 in combination with:

an electrical device that is electrically connected to the first and/or second contacts and is configured to become operative upon the first and second magnetic switch contacts making or breaking electrical connection between one another.

35. A magnetic switch according to claim 34 in further combination with an encapsulating structure, and wherein the substrate and the electrical device are encapsulated by the encapsulating structure.

36. A magnetic switch according to claim 1 further comprising:

a permanent magnet that generates a constant magnetic field to maintain the rotor in a predetermined position, the rotor being configured to rotate from the predetermined position in response to the changed magnetic field.

37. A magnetic switch according to claim 1 further comprising:

at least one mechanical stop attached to the substrate in a way that limits the motion of the deformable beam; and a latch that is configured to maintain position of the deformable beam touching the mechanical stop.

38. A magnetic switch according to claim 37 wherein the latch comprises a snapping tether that is coupled to the deformable beam to allow its movable end to extend beneath the head portion.

39. A magnetic switch comprising:

a substrate including therein a recess;

a rotor that includes a tail portion that overlies the recess and a head portion that extends on the substrate outside the recess, the head portion and the tail portion of the rotor comprising ferromagnetic material and being configured to rotate the tail in the recess in response to a changed magnetic field the rotor being balanced in relation to a torsional hinge used to mount the rotor to the substrate; and first and second magnetic switch contacts that are configured to make or break electrical connection between one another in response to rotation of the tail in the recess in response to the changed magnetic field, and at least one deformable beam having a fixed end attached to the substrate and a movable end extending beneath the head portion to allow for contact with the head portion in its rest position and/or to provide the torsional hinge with mechanical bias.

40. A magnetic switch comprising:

a substrate including therein a recess;

a rotor connected to the substrate by torsional hinge means for mechanically biasing the rotor to a first position in relation to the substrate in the absence of a magnetic field, the rotor being balanced in relation to the torsional hinge, the rotor including a tail portion that overlies the recess and a head portion that extends on the substrate outside the recess, the rotor comprising unmagnetized ferromagnetic material and being configured to rotate the rotor to a second position in response to a changed magnetic field, the tail being in the recess when the rotor is in the second position; and first and second magnetic switch contacts that are configured to make or break electric connection between one another in response to rotation of the tail in the recess in response to the changed magnetic field, and at least one deformable beam having a fixed end attached to the substrate and a movable end extending beneath the head portion to allow for contact with the head portion in its rest position and/or to provide the torsional hinge with mechanical bias.

* * * * *